US005432293A

United States Patent [19]

Nonaka et al.

[11] Patent Number: 5,432,293

[45] Date of Patent: Jul. 11, 1995

[54] WAVEFORM GENERATION DEVICE CAPABLE OF READING WAVEFORM MEMORY IN PLURAL MODES

[75] Inventors: Tasuya Nonaka; Masaki Kudo; Kyoko Ohno; Tokio Shirakawa, all of Hamamatsu, Japan

[73] Assignee: Yamaha Corporation, Japan

[21] Appl. No.: 990,408

[22] Filed: Dec. 10, 1992

[30] Foreign Application Priority Data

Dec. 13, 1991 [JP] Japan ..... 3-352056

[51] Int. Cl.[6] ..... G10H 1/057; G10H 1/12; G10H 7/02; G10H 7/12

[52] U.S. Cl. ..... 84/607; 84/624; 84/627; 84/633; 84/DIG. 9

[58] Field of Search ..... 84/603-607, 84/617, 622-633, 655, 659-665, 682, 692-711, DIG. 9

[56] References Cited

U.S. PATENT DOCUMENTS 3,610,799 10/1971 Watson ..... 84/617
3,908,504 9/1975 Deutsch ..... 84/623
4,246,823 1/1982 Wachi et al. .
4,696,214 9/1987 Ichiki ..... 84/603

*Primary Examiner*—Staley J. Witkowski
*Attorney, Agent, or Firm*—Graham & James

[57] ABSTRACT

Reading of a waveform memory is controlled and one of different processing is performed depending upon which of a first mode and a second mode has been designated. When the first mode has been designated, an interpolation operation is performed on the basis of plural sample value data read from the waveform memory by using a predetermined number of processing time slots and a resulting one waveform sample value data is produced. When the second mode, has been designated, a processing for producing one waveform sample value data is performed on the basis of one sample value data read from the waveform memory by using one processing time slot. By using a predetermined plural number of processing time slots, one waveform sample value data produced with a high accuracy in the first mode whereas plural waveform sample value data are produced in the second mode whereby generation of a waveform can be performed efficiently by properly utilizing the mode.

33 Claims, 18 Drawing Sheets

WAVEFORM GENERATION DEVICE CAPABLE OF READING WAVEFORM MEMORY IN PLURAL MODES

BACKGROUND OF THE INVENTION

This invention relates to a waveform generation device (tone source) having a-waveform memory and, more particularly, to a waveform generation device which generates, for example, a first waveform requiring an interpolation operation and a second waveform requiring no such interpolation operation, while switching generation of these waveforms properly on a time shared basis.

In electronic musical instruments, a waveform generation device has been conventionally employed for generating a waveform, an envelope shape and various control functions for tone controls. As such waveform generation device, there is one, for example, which has a waveform memory storing waveform amplitude values at sequential sample points of a certain waveform, sequentially accumulates, by an accumulator, frequency information (constant) F corresponding to a tone pitch of a tone to be generated, and reads the waveform memory to provide waveform data by using an integer section I of sequentially provided accumulated value qF (q=1, 2, 3, . . .) as an address.

In this prior art waveform generation device, the waveform memory is accessed by using, as the address, the integer section I of the accumulated value qF (q=1, 2, 3, . . .) of the frequency information F (so called F number).and this brings about quantizing of the time base. In other words, a decimal section of the accumulated value qF is neglected. Besides, the waveform amplitude values stored in respective addresses of the waveform memory are digital data which are, dispersed values appearing at a predetermined time interval. Accordingly, a tone waveform which is read from the waveform memory by the address signal I (integer) naturally contains an unwanted quantizing noise.

For solving this problem, there has been proposed a system in which an amplitude value at a desired position is obtained by arithmetic operation on the basis of amplitude values at plural sample points. U.S. Pat. No. 4,246,823, for example, discloses a waveform generation device according to which a waveform amplitude value between adjacent basic sample points is calculated and provided by an inserted interpolation on the basis of waveform amplitude values of respective basic sample points designated by an integer section of an address signal.

According to this waveform generation device, a memory capacity can be saved and a waveform having an accurate time base and containing little quantizing noise can be produced.

Among tones generated,by an electronic musical instrument, there are some tones that require tone waveforms which are produced with a high accuracy but there are also other tones that require no such accurate waveform. Rhythm sounds, for example, do not require such accurate waveform and, therefore, it is unnecessary to obtain accurate waveform data by interpolation.

SUMMARY OF THE INVENTION

It is, therefore, an object of the invention to provide a waveform generation device in which a processing for obtaining waveform data of a high accuracy by employing an operation such as interpolation is combined with a processing for generating waveform data requiring no such operation and which therefore has increased suitability for use in a waveform generation device of an electronic musical instrument.

For achieving the above described object of the invention, a waveform generation device according to the invention comprises a waveform memory for storing waveform sample value data, a mode designation section for designating a first mode or a second mode, and a processing section for controlling reading of the waveform memory depending upon which of the first mode and the second mode is designated and, when the first mode has been designated, performing a processing for producing and outputting one waveform sample value data on the basis of plural sample value data read from the waveform memory means and, when the second mode has been designated, performing a processing for producing and outputting one waveform sample value data on the basis of one sample value data read from the waveform memory.

The processing performed by the processing section when the first mode has been designated is, for example, a processing for performing a predetermined interpolation operation by using plural sample value data read from the waveform memory. Waveform sample value data can thereby be generated with a higher accuracy than accuracy of data stored in the waveform memory. In contrast, when the second mode has been designated, one waveform sample value data is produced on the basis of one sample value data read from the waveform memory and, therefore, the above described interpolation is not performed but waveform sample value data is generated with the same accuracy as data stored in the waveform memory. In the second mode, operation time for interpolation is not required and, therefore, sample value data for more waveforms can be generated.

For example, in a case where a tone signal generation processing is performed in one processing channel consisting of a predetermined number of processing time slots, in the first mode, plural sample value data are read out in processing time slots of a predetermined number and one waveform sample value data is generated on the basis of the read out data whereas, in the second mode, waveform sample value data of different waveforms can be respectively read out in processing time slots of predetermined number which constitute one processing channel and, accordingly, different waveform signals can be generated by using one processing channel.

Accordingly, by designating the first mode and the second mode properly in accordance with nature of a tone waveform to be generated (e.g., difference of nature such that a high accuracy is required OF such a high accuracy is not required but it is preferable to secure a number of tones which can be generated simply), the waveform generation device can be utilized effectively. In an embodiment to be described later, by way of example, the first mode is designated in a case where a tone waveform signal corresponding to a scale note designated in a keyboard should be generated with a high accuracy and the second mode is designated in a case where waveform signals of plural percussion instruments corresponding to a selected rhythm should be generated with a simple structure.

In the first mode, one envelope shape signal imparted to a generated tone waveform signal is generated in correspondence to one tone waveform signal formed in one processing channel whereas in the second mode, different envelope shape signals are generated respectively for plural tone waveform signals formed in one processing channel.

A predetermined number of processing time slots constituting one processing channel need not necessarily be continuous. The dispersed allotment of processing time slots corresponding to one processing channel can be conveniently utilized for coping with a signal delay in data processing.

An embodiment of the invention will now be described with reference to the accompanying drawings.

BRIEF DESCRIPTION OF THE DRAWINGS

In the accompanying drawings.

DESCRIPTION OF PREFERRED EMBODIMENTS

Figure 1:
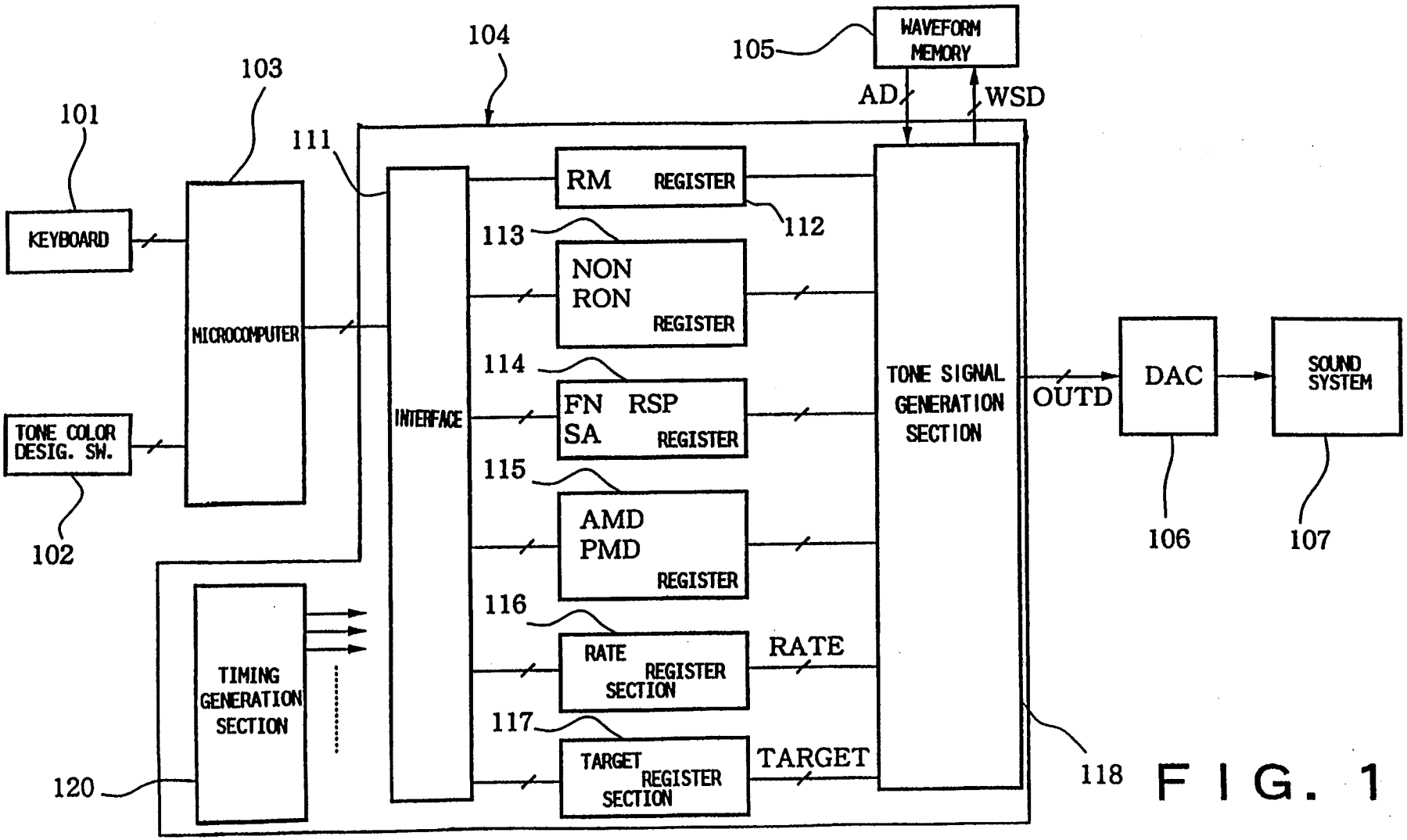
FIG. 1 is a block diagram showing an electronic musical instrument in which an embodiment of the waveform generation device according to the invention is applied to a tone source thereof.

FIG. 1 is a block diagram showing an electronic musical instrument in which an embodiment of the waveform generation device according to the invention is applied to a tone source thereof. The electronic musical instrument of this figure includes a keyboard 101 having plural keys and outputting a key code corresponding to a depressed key, a tone color designation switch 102 for designating a tone color of a tone, a microcomputer 103 for generating and outputting an F number (frequency information) representing a frequency corresponding to a key code produced by the keyboard 101 and parameters for generating a tone waveform of a tone color corresponding to designation by the tone color switch 102, a tone source 104 for generating and outputting a tone waveform in response to a command from a microcomputer 103, a waveform memory 105 storing data including previously PCM (PCM is an abbreviation of Pulse Coded Modulation) modulated tone waveform data and rhythm sound waveform data, a D/A converter 106 for digital-to-analog converting a tone signal OUTD provided by the tone source 104, and a sound system 107 for generating a tone on the basis of an analog tone signal supplied from the D/A converter 106.

The tone source 104 includes an interface 111 for writing various data provided by the microcomputer 103 in respective register sections provided therefor. Data of the respective register sections are supplied to a tone signal generation section 118. The tone signal generation section 118 accesses the waveform memory 105 in accordance with input data to provide predetermined waveform data. This tone source 104 has two operation modes of a normal mode and a rhythm mode. In the normal mode, the tone source 104 functions as a PCM tone source (producing actually a waveform which is synthesized with a PCM waveform and an FM waveform) of 32 channels (0-th channel to thirty-first channel). In the rhythm mode, the tone source 104 functions as a PCM tone source of 30 channels and a rhythm sound source of 8 channels. Here, FM is an abbreviation of Frequency Modulation.

Processing in each channel is performed on a time shared basis. Particularly, an arrangement is made so that, as regards waveform data of a rhythm sound in the rhythm mode, processing for 8 channels of the rhythm sound is made at processing timings of the thirtieth and thirty-first channels of the normal mode. Such time division processing will be described more fully later. The time division processing is performed in response to various timing signals produced by a timing generation section 120. The timing generation section 120 will be described more fully later with reference to FIG. 2.

There are the following registers in which data is written through the interface 111:

(1) A mode (RM) register (FIG. 1, reference character 112): This is a one-bit register. When the value of this register is "0" it represents the normal mode and, when the value of this register is "1" it represents the rhythm mode.

(2) A note-on (NON) register (FIG. 1, reference character 113): This is a one-bit register designating generation of a PCM tone. There are provided 32 note-on registers in correspondence to the respective channels of the PCM tone source. When a certain key has been depressed, the microcomputer 103 detects the key and thereupon assigns a channel for generating a tone based on the PCM tone source. A NON register corresponding to the assigned channel is turned to "1". Upon release of the key, the NON register is restored to "0".

(3) A rhythm-on (RON) register (FIG. 1, reference character 113): This is a one-bit register designating generation of a rhythm sound. There are provided 8 RON registers in correspondence to the respective channels of the rhythm sound source. When a rhythm sound is to be produced, the microcomputer 103 assigns a channel for generating the rhythm sound. The RON register corresponding to the assigned channel is turned to "1".

(4) An F number (FN) register (FIG. 1, reference character 114): This is a 25-bit register. There are provided 32 FN registers in correspondence to the respective channels of the PCM tone source. When a certain key has been depressed, the microcomputer 103 sets an F number corresponding to the key code of the depressed key in a corresponding FN register. The F number is sequentially accumulated and added to a start address (stored in an SA register to be described below) to constitute a sequential read address for accessing the waveform memory.

(5) A start address (SA) register (FIG. 1, reference character 114): This is a register for storing a start address of addresses for reading data from the waveform memory. There are provided 32 SA registers in correspondence to the respective channels of the PCM tone source.

(6) A rhythm read speed (RSP) register (FIG. 1, reference character 114): This is a 2-bit register storing read speed for reading waveform data of a rhythm sound stored in the waveform memory and corresponds, so to speak, to the F number of the PCM tone source. There are provided 8 RSP registers in correspondence to the respective channels of the rhythm sound source.

(7) An amplitude modulation depth (AMD) register (FIG. 1, reference character 115): This is a register storing parameters for controlling depth of amplitude modulation in an LFO (low frequency oscillator).

(8) A pitch modulation depth (PMD) register (FIG. 1, reference character 115): This is a register storing parameters for controlling depth of pitch modulation in the LFO.

(9) A rate register section (FIG. 1, reference character 116): An envelope generator (hereinafter referred to as EG) included in the tone generation section 118 of the tone source of this embodiment is a multi-function EG realizing plural functions. The rate register section 116 produces a parameter RATE to be supplied to the multi-function EG. The multi-function EG can realize different functions at respective time division timings and, accordingly, a parameter corresponding to a function which is realized by the EG at a given timing is supplied as the parameter RATE. A specific structure of the rate register section 116 will be described later with reference to FIG. 6.

(10) A target register section (FIG. 1, reference character 117): The target register section 117 produces a parameter TARGET to be supplied to the multi-function EG. At each time division timing at which the multi-function EG realizes one of its functions, a corresponding parameter is supplied as the parameter TARGET. A specific structure of the target register section 117 will be described later with reference to FIG. 7.

The symbols used for designating the above described registers are used also for designating data stored in these registers. For example, the symbol RM designates the mode register and, also, a mode value as data stored in the mode register. The same is the case with all other registers to be described below.

Writing in these registers may be made in any suitable manner and at any suitable timing.

Figure 2:
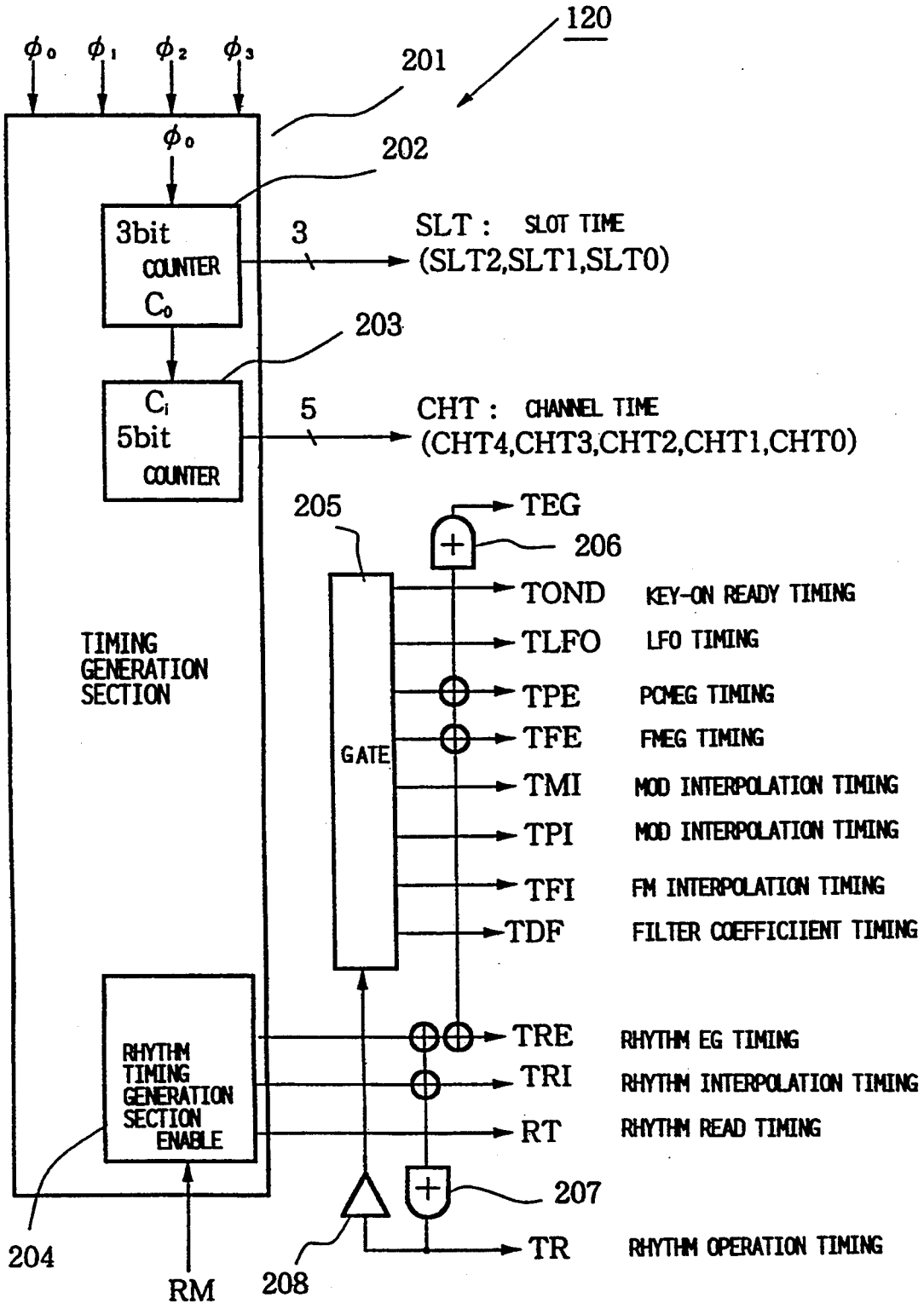
FIG. 2 is a block diagram showing an example of a timing generation section in FIG. 1.

FIG. 2 is a block diagram showing a specific structure of the timing generation section 120 of FIG. 1. The timing generation section 120 has a timing generator 201 including a 3-bit counter 202, a 5-bit counter 203 and a rhythm timing generation section 204. To the timing generator 201 are applied clock signals $\phi 0$, $\phi 1$, $\phi 2$ and $\phi 3$. The clock signal $\phi 0$ is a clock pulse which is of the highest frequency in this device and at which "0" and "1" are switched. The clock signal $\phi 1$ is a clock pulse obtained by two-dividing the clock signal $\phi 0$ in frequency, the clock signal $\phi 2$ is a clock pulse obtained by two-dividing the clock $\phi 1$ in frequency and the clock signal $\phi 3$ is a clock pulse obtained by two-dividing the clock $\phi 2$ in frequency.

A 3-bit counter 202 repeatedly counts "0" to "7" in response to the clock signal $\phi 0$. The 3-bit count is provided as a slot time SLT. In other words, the slot time SLT is provided in the manner of "0", "1", "2", . . . "7", "0", "1", . . . in decimal notation. The least significant bit of the 2-bit slot time SLT is designated SKT0, the next bit as SLT1 and the most significant bit as SLT2.

A 5-bit counter 203 receives a carry signal from the 3-bit counter 202 and repeatedly counts from "0" to "31". The 5-bit count is provided as a channel time CHT. In other words, the channel time CHT is provided in the sequence of "0", "1", "2", . . . "31", "0", "1", . . . in decimal notation. The least significant bit of the channel time CHT is designated as CHT0, more significant bits as CHT1, CHT2 and CHT3 in the order from the LSB and the most significant bit as CHT4.

Considering the 3-bit counter 202 as a low-order counter and the 5-bit counter 203 as a high-order counter, these counters constitute a counter which repeatedly counts from "0" to "255".

The timing generator 201 generates, in response to an applied clock signal and at a respective predetermined timing, a key-on delay timing signal TOND, an LFO timing signal TLFO, a PCM EG timing signal TPE, an FM EG timing signal TFE, an FM modulation factor level interpolation timing signal TMI, a PCM level interpolation timing signal TPI, an FM level interpolation timing signal TFI and a filter coefficient processing timing signal TDF.

The rhythm timing generation section 204 receives the mode RM as an enable signal. When the mode RM is "1", i.e., rhythm mode, the rhythm timing generation section 204 generates, at respective predetermined timings, a rhythm sound EG timing signal TRE, a rhythm sound interpolation timing signal TRI and a rhythm read timing signal RT for generating a rhythm sound. When the mode RM is "0", i.e., the normal mode, the rhythm timing generation section 204 does not generate these timing signals for generating a rhythm sound.

An OR gate 207 calculates the logical OR of the rhythm sound EG timing signal TRE and the rhythm sound interpolation timing signal TRI and provides result of the calculation as a rhythm operation timing signal TR. The output of the OR gate 207 is inverted by an inverter 208 and a gate 205 is closed and opened in response to the output of the inverter 208. When, therefore, the mode RM is "1" and a timing signal for generating a rhythm sound is generated, the timing signals TOND, TLFO, TPE, TFE, TMI, TPI and TDF for generating tones other than this rhythm sound are not generated.

An OR gate 206 calculates a logical OR of the PCM EG timing signal TPE, FM EG timing signal TFE and rhythm sound EG timing signal TRE. Result of the calculation is provided as an EG operation timing signal TEG.

Figure 3:
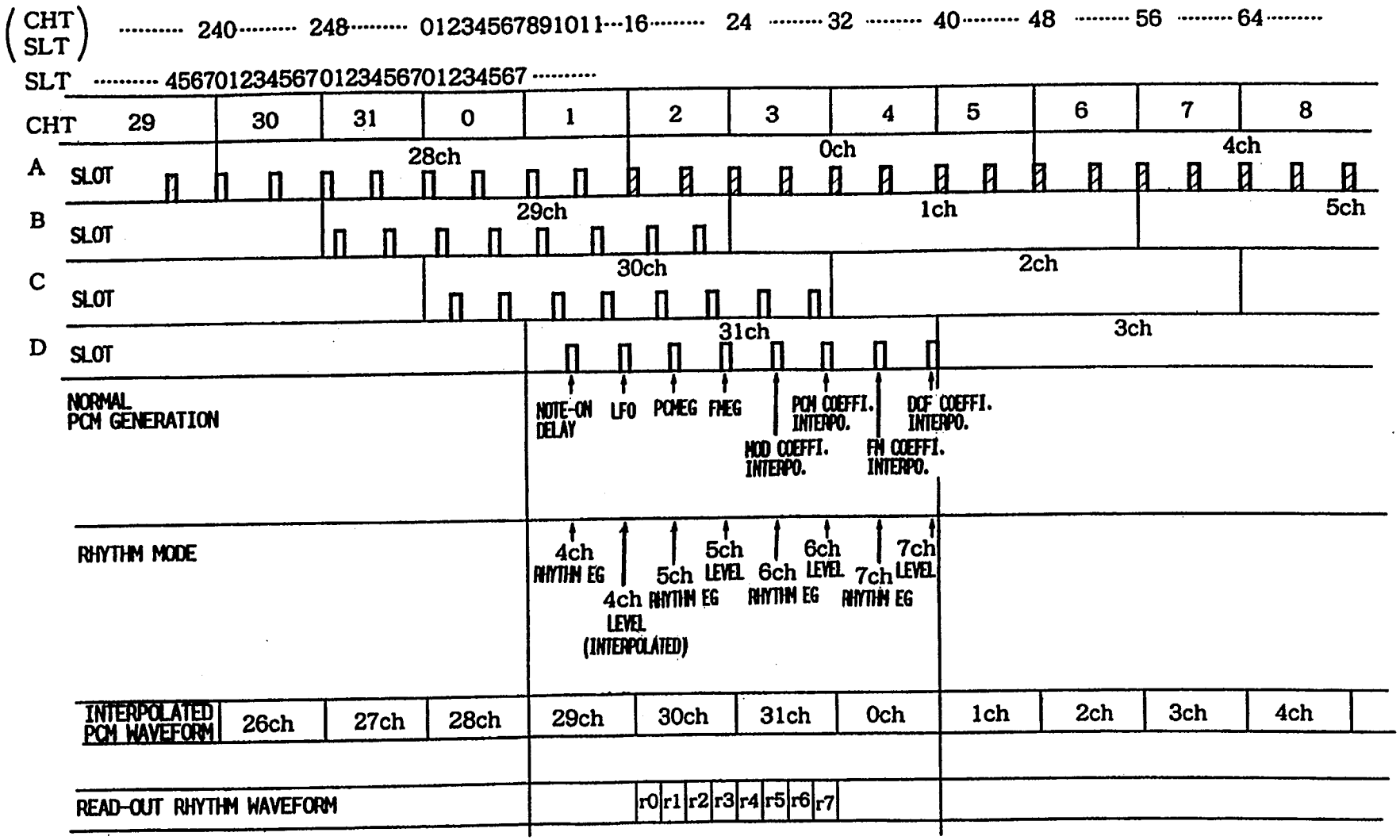
FIG. 3 is a time chart showing respective timing signals.

FIG. 3 is a time chart showing timing signals produced by the timing generation section 120 of FIG. 2. Since the EG in the tone signal generation section 118 performs different functions at respective timings at which these timing signals are produced, FIG. 3 may be said to represent data which is currently being processed by the EG.

In FIG. 3, the line of the channel time CHT and the slot time SLT written vertically and parenthesized together (i.e., the line at which the values "0" to "255" are repeated) exhibits an 8-bit value in which the channel time CHT constitutes a high order value and the slot time SLT constitutes a low order value. The line of SLT (i.e., the line at which the values "0" to "31" are repeated) represents a value of the channel time CHT produced by the timing generation section 120.

The tone source of this embodiment performs a processing of one channel at skipped time slots. For example, with reference to FIG. 3, a processing concerning generation of a waveform in PCM in the twenty-eighth channel is performed at the following timing:

(1) When CHT is 30 and SLT is 0, the key-on delay timing signal TOND is generated and thereupon the EG performs a key-on delay processing.

(2) When CHT is 30 and SLT is 4, the PCM EG timing signal TLFO is generated and thereupon the EG performs the LFO processing. Hereinafter, it is to be noted that LFO is an abbreviation of Low Frequency.

(3) When CHT is 31 and SLT is 0, the PCM EG timing signal TPE is generated and thereupon the EG performs the PCM EG processing (i.e., envelope generation processing).

(4) When CHT is 31 and SLT is 4, the FM EG timing signal TFE is generated and thereupon the EG performs FM EG processing (i.e., envelope generation processing).

(5) When CHT is 0 and SLT is 0, the FM modulation factor level interpolation timing signal TMI is generated and thereupon the EG performs the FM tone source modulation factor level interpolation processing.

(6) When CHT is 0 and SLT is 4, the PCM level interpolation timing signal TPI is generated and thereupon the EG performs the PCM level interpolation processing.

(7) When CHT is 1 and SLT is 0, the FM level interpolation timing signal TFI generated and thereupon the EG performs the FM level interpolation processing.

(8) When CHT is 1 and SLT is 4, the filter coefficient processing timing signal TDF is generated and thereupon the EG performs the interpolation operation for the filter coefficient of a digital filter of the operation section.

Likewise, processing timings in, for example, the twenty-ninth, thirtieth and thirty-first channels are generated in the illustrated manner. The respective timing signals TOND etc. in the twenty-ninth channel are generated when the slot time SLT is "1" and "5". The respective timing signals in the thirtieth channel are generated when the slot time SLT is "2" and "6". The respective timing signals in the thirty-first channel are generated when the slot time SLT is "3" and "7".

As shown in FIG. 3, the line at which timing signals are generated when the slot time SLT is "0" and "4" and these slots are referred to as "A slot". Likewise, a portion in which the slot time SLT is "1" and "5" is referred to as "B slot", a portion in which the slot time SLT is "2" and "6" as "C slot" and a portion in which the slot time SLT is "3" and "7" as "D slot", respectively.

The A slot is one at which the timing signals of the 0-th, fourth, eighth,-twelfth, sixteenth, twentieth, twenty-fourth and twenty-eighth channels are generated. The B slot is one at which the timing signals of the first, fifth, ninth, thirteenth, seventeenth, twenty-first, twenty-fifth and twenty-ninth channels are generated. The C slot is one at which the timing signals of the second, sixth, tenth, fourteenth, eighteenth, twenty-second, twenty-sixth and thirtieth channels are generated. The D slot is one at which the timing signals of the third, seventh, eleventh, fifteenth, nineteenth, twenty-third, twenty-seventh and the thirty-first channels are generated.

As described previously, in the tone source of this embodiment, a part of timings at which the waveform generation processing is performed normally in PCM is used for generation of a waveform of a rhythm sound during the rhythm mode. More specifically, during the rhythm mode, the respective timings of the thirtieth channel of the C slot and the thirty-first channel of the D slot are substituted by the timing signals for the waveform generation processing for a rhythm sound. That is, during the normal mode (RM=0), the above described timing signals TOND etc. are generated for generation of a waveform in the thirtieth and thirty-first channels of the PCM tone source whereas, during the rhythm mode (RM=1), the eight timings of the thirtieth channel of the C slot are used in the following manner:

(1) When CHT is 0 and SLT is 2, the EG timing signal TRE for the 0-th channel of the rhythm sound is generated and thereupon the envelope generation processing for the rhythm sound is performed.

(2) When CHT is 0 and SLT is 6, the timing signal for the level interpolation of the 0-th channel of the rhythm sound is generated and thereupon the processing for generating interpolated level data of the rhythm sound is performed.

(3) Likewise, when CHT is 1 and SLT is 2, the rhythm sound EG processing for the first channel of the rhythm sound is performed. When CHT is 1 and SLT is 6, the rhythm sound level interpolation processing for the first channel of the rhythm sound is performed. When CHT is 2 and SLT is 2, the rhythm sound EG processing for the second channel of the rhythm sound is performed. When CHT is 2 and SLT is 6, the rhythm sound level interpolation processing for the second channel of the rhythm sound is performed. When CHT is 3 and SLT is 2, the rhythm sound EG processing for the third channel of the rhythm sound is performed. When CHT is 3 and SLT is 6, the rhythm sound level interpolation processing for the third channel of the rhythm sound is performed.

Likewise, during the rhythm mode, the eight timings of the thirty-first channel of the D slot are used in the following manner:

(1) When CHT is 1 and SLT is 3, the EG timing signal TRE for the fourth channel of the rhythm sound is generated and thereupon the envelope generation processing for the rhythm sound is performed.

(2) When CHT is 1 and SLT is 7, the timing signal TRI for the level interpolation for the fourth channel of the rhythm sound is generated and thereupon the processing for generating interpolation level data of the rhythm sound is performed.

(3) Likewise, when CHT is 2 and SLT is 3, the rhythm sound EG processing for the fifth channel of the rhythm sound is performed. When CHT is 2 and SLT is 7, the rhythm sound level interpolation processing for the fifth channel of the rhythm sound is performed. When CHT is 3 and SLT is 3, the rhythm sound EG processing for the sixth channel of the rhythm sound is performed. When CHT is 3 and SLT is 7, the rhythm sound level interpolation processing for the sixth channel of the rhythm sound is performed. When CHT is 4 and SLT is 3, the rhythm sound EG processing for the seventh channel of the rhythm sound is performed. When CHT is 4 and SLT is 7, the rhythm sound level interpolation processing for the seventh channel of the rhythm sound is performed.

As described previously, the value of the channel time CHT is different from the processing channel such as, for example, the processing of the twenty-eighth channel is started from a position at which the channel time CHT is "30" and the processing of the twenty-ninth channel is started from a position at which the channel time CHT is "31". This arrangement is made for causing the processing in each channel to synchronize with the timing at which PCM waveform data which is read from the waveform memory 5 and interpolated is provided. In this embodiment, having regard to the speed of multipliers constituting the circuit, the eight functions are executed at every four time slots for generating a PCM waveform in each channel. Owing to this structure employing the skipped slot arrangement, necessity for synchronizing timings compulsorily by providing delay circuits at many points of the circuit is reduced whereby the number of delay circuit required in the circuit can be reduced.

Figure 4:
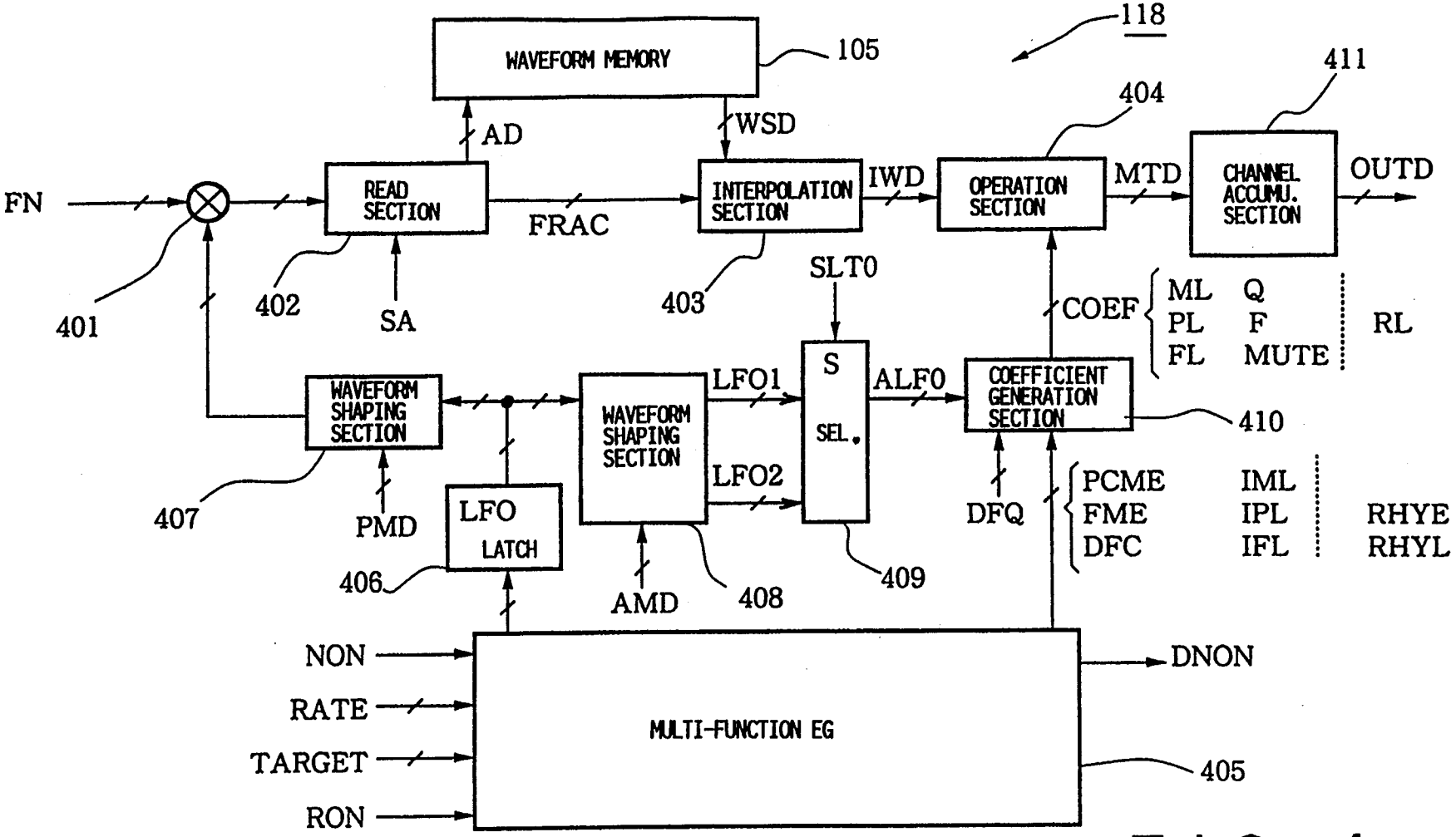
FIG. 4 is a block diagram showing an example of a tone signal generation section in FIG. 1.

FIG. 4 is a block diagram showing a specific construction of the tone signal generation section 118. The tone signal generation section 118 of this embodiment includes a multiplier 401, a read section 402, an interpolation section 403, an operation section 404, a multi-function EG 405, an LFO latch 406, a waveform shaping section.407, a waveform shaping section 408, a selector 409, a coefficient generation section 410 and a channel accumulation section 411.

An F number FN applied to the tone signal generation section 118 is applied to the multiplier 401 and multiplied with an output of the waveform shaping section 407. The multi-function EG 405 has a function of an LFO and the LFO output from the multi-function EG 405 is applied to the waveform shaping section 407 through the latch 406. The waveform shaping section 407 processes the LFO output from the latch 406 in accordance with the parameter PMD representing the pitch modulation depth and thereafter supplies the processed output to the multiplier 401. By this processing, the output of the multiplier 401 becomes an F number in which the pitch modulation depth PMD is reflected and this F number FN is applied to the read section 402.

To the read section 402 is applied the start address and other signals. The read section accumulates the input F numbers and sequentially produces an address AD for accessing the waveform memory 105. The waveform memory 105 prestores tone waveform data and rhythm sound waveform data. Accordingly, the read section 402 generates read address for the PCM waveform data and also generates, during the rhythm mode, read address for the rhythm sound waveform data.

In the tone source of this embodiment, sample data at four sample points are read from the waveform memory 105 and these data are interpolated to generates a PCM waveform. For this purpose, the read section 402 generates fraction data FRAC for the interpolation. Since the waveform data of a rhythm does not need interpolation (such accuracy is unnecessary for a rhythm sound), data read from the waveform memory is directly supplied.

In accordance with the address AD from the read section 402, sample data WSD (for four sample points) is read from the waveform memory 105. The interpolation section 403 receives the read out sample data WSD and the fraction data FRAC provided by the read section 402 and performs interpolation using the four point sample data to produce PCM tone waveform data. Waveform data of a rhythm sound is directly provided after being subjected to a delay processing so that the waveform data is provided at the same timing as the output timing of the PCM tone waveform data. Waveform data output IWD from the interpolation section 403 is applied to the operation section 404.

The multi-function EG 405 realizes plural functions. These functions are performed at timings at which the above described timing signals are produced. The multi-function EG 405 supplies output data for realizing a predetermined function to the coefficient generation section 410 at a predetermined timing. The coefficient generation section 410 supplies, at a predetermined timing, a coefficient COEF for the function to be realized to the operation section 404. The operation section 404 performs an operation processing (e.g., imparting of an envelope) in accordance with the coefficient COEF from the coefficient generation section 410 thereby producing final waveform data MTD. Operations and functions of the multi-function EG 405, coefficient generation section 410 and operation section 404 will be described later.

The waveform data MTD provided by the operation section 404 is applied to the channel accumulation section 411 where it is accumulated by channel and is supplied as an output of the tone source 104 to the D/A converter 106 (FIG. 1).

The multi-function EG 405 functions also as an LFO. The LFO output from the multi-function EG 405 is latched by the latch 406 and thereafter is applied to the waveform shaping section 407 as described above and also is applied to the waveform shaping section 408. The waveform rectification section 408 processes the LFO output from the latch 406 in accordance with the parameter AMD representing the amplitude modulation depth and the output of the waveform shaping section 408 is applied to the coefficient generation section 410 through the selector 409. By causing the LFO output from the waveform shaping section 408 to be reflected in the coefficient generated by the coefficient generation section 410, PCM waveform data is subjected to a predetermined amplitude modulation.

Figure 5:
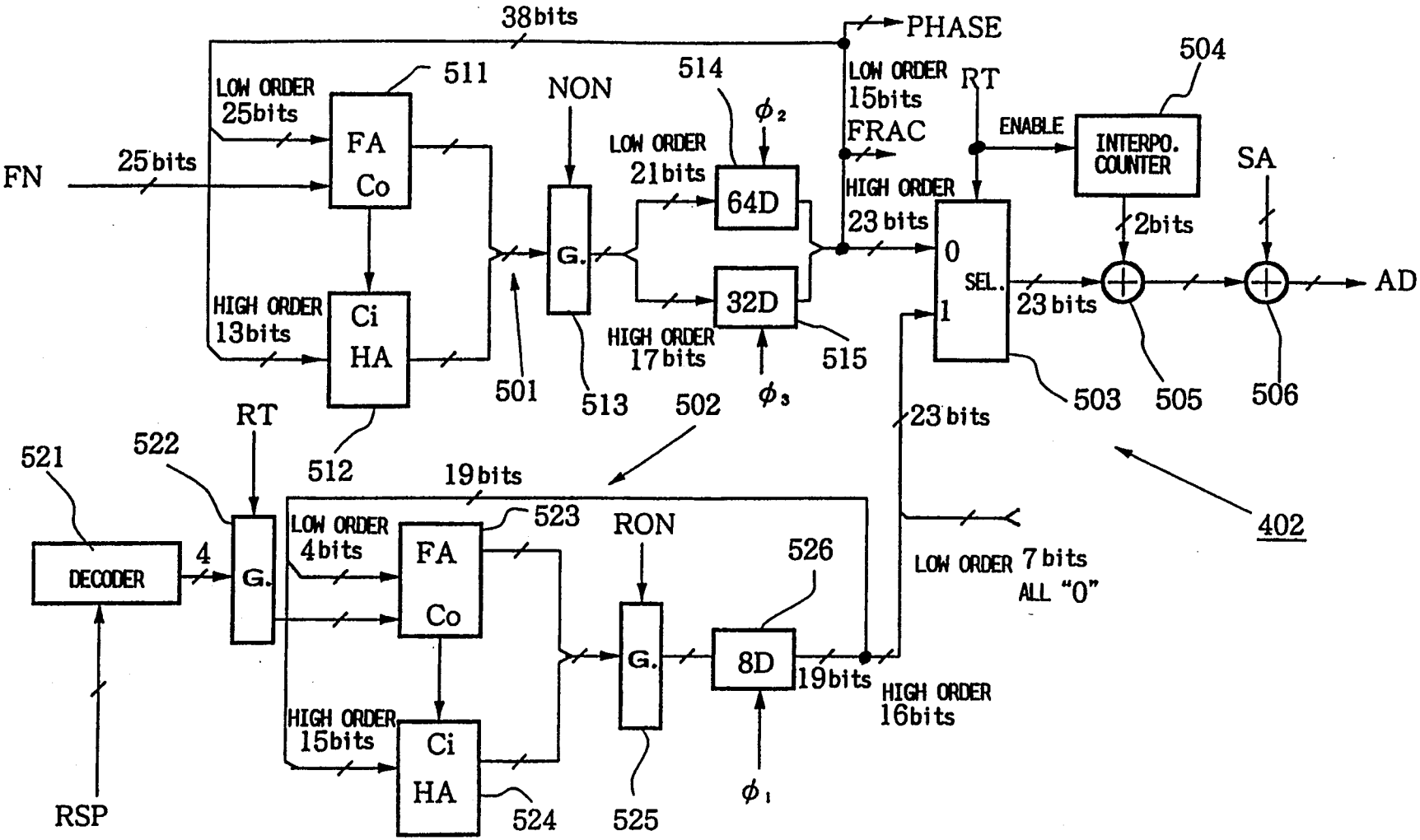
FIG. 5 is a block diagram showing an example of a read section in FIG. 4.

Referring now to FIG. 5, description will be made about the read section 402. The read section 402 includes a PCM address counter section 501 and a rhythm address counter section 502. The PCM address counter section 501 includes a full adder 511, a half adder 512, a gate 513, a shift register 514 which is a delay circuit having a storage area of 21 bits×64 stages and a shift register 515 which is a delay circuit having a storage area of 17 bits×32 stages.

The F number FN is applied to the full adder 511 and added to low order 25 bits of an output of 38 bits from the PCM address counter section 501. A carry signal of the full adder is applied to a carry-in of the half adder 512. When the carry-in is applied, the half adder 512 performs a carry (i.e., count up) with respect to high order 13 bits among 38 bits of the output from the PCM address counter section 501. The output of the full adder 511 (low order 25 bits) and the output of the half adder 512 (high order 13 bits) are applied to the gate 513.

The gate 513 is on when the note-on register NON is "1" and off when the note-on register NON is "0". Low order 21 bits in the output of the gate 513 are applied to the shift register 514 of 64 stages and high order 17 bits are applied to the shift register 515 of 32 stages.

The shift register 514 sequentially shifts input data of 21 bits to a next stage in response to the clock signal $\phi 2$. The clock signal $\phi 2$ is a clock signal which is produced twice per one channel time (i.e., time period during which CHT holds one value) as has been described with reference to FIGS. 2 and 3. In the shift register 514, therefore, low order data of 21 bits is shifted twice per one channel time.

In the shift register 515, input data of 17 bits is sequentially shifted to a next stage in response to the clock signal $\phi 3$. The clock signal $\phi 3$ is a clock signal which is produced once per one channel time as has been described with reference to FIGS. 2 and 3. In the shift register 515, therefore, high order data of 17 bits is shifted once per one channel time.

The two divided shift registers are provided because there is a case where high order 17 bits are unnecessary in some channels. When, for example, the phase of FM is calculated, it will suffice if one period of sine wave waveform data at the maximum is read out and, accordingly, high order 17 bits are unnecessary in this case.

Among the outputs of the shift register 514 and the shift register 515 (totalling 38 bits), low order 25 bits are applied to the full adder 511 and high order 13 bits are applied to the half adder 512. The accumulation of the F number is realized by this loop circuit. Among the 38-bit outputs of the shift registers 514 and 515, high order 23 bits are applied also to the selector 503 as an integer section of the address for accessing the waveform memory. Low order 15 bits of the outputs of the shift registers 514 and 515 are provided as a fraction section FRAC of the address for accessing the waveform memory. Further, 12 bits among the low order 21 bits are provided as phase data PHASE of FM.

The rhythm address counter section 502 includes a decoder 521, a gate 522, a full adder 523, a half adder 524 and a shift register 526 which is a delay circuit having a storage area of 19 bits$\times$8 stages.

The decoder 521 decodes the 2-bit rhythm read speed RSP. When the rhythm read speed RSP is "00", the address which is provided by the rhythm address counter section 502 is stepped by one step upon generation of 8 clock signals 1. Likewise, when the rhythm read speed RSP is "01", the address is stepped by one step at every 4 clock signals. When the rhythm read speed RSP is "10", the address is stepped by one step at every 2 clock signals. When the rhythm read speed RSP is "11", the address is stepped by one step at each clock signal 1.

The gate 522 is opened and closed in response to the rhythm read timing RT. The rhythm read timing RT is "1" when the channel time CHT is "30" or "31" during the rhythm mode and otherwise is "0". When, therefore, the channel time CHT is "30" or "31" during the rhythm mode only, the output of the decoder 521 is applied to the full adder 523 through the gate 522.

The full adder 523 is a full adder of 4 bits with its one input being low order 4 bits from the shift register 526 and its other input being 4 bits from the gate 522. In the 4 bits from the gate 522, the line which becomes "1" when the rhythm read speed RSP is "00" is connected to the least significant bit ($2^0$ bit) of the 4-bit full adder 523. Accordingly, the full adder 523 adds 4-bit data "0001" to the low order 4 bits from the shift register 526.

The output line from the gate 522 which becomes "1" when the rhythm read speed RSP is "01" is connected to a bit next to the least significant bit (2 bit) of the 4-bit full adder 523. When, therefore, the rhythm read speed RSP is "01", the full adder 523 adds 4-bit data "0010" to lower order 4-bits from the shift register 526.

The output line from the gate 522 which becomes "1" when the rhythm read speed RSP is "10" is connected a further next bit ($2^2$ bit) of the 4-bit full adder 523. When, therefore, the rhythm read speed RSP is "10", the full adder 523 adds 4-bit data "0100" to low order 4 bits from the shift register 526.

The output line from the gate 522 which becomes "1" when the rhythm read speed RSP is "11" is connected the most significant bit ($2^3$ bit) of the 4-bit full adder 523. When, therefore, the rhythm read speed RSP is "11", the full adder 523 adds 4-bit data "1000" to low order 4 bits from the shift register 526.

A carry signal from the full adder 523 is applied to the carry-in of the half adder 524. When the carry signal is applied, the half adder 524 performs a carry (count up) with respect to high order 15 bits among 19-bit output from the shift register 526. The output of the full adder 523 (low order 4 bits) and the output of the half adder 524 (high order 15 bits) are applied to the gate 525.

The gate 525 is on when the rhythm-on register RON is "1" and off when the rhythm-on register RON is "0". The 19-bit output of the gate 525 is applied to the 8-stage shift register 526. The shift register 526 performs sequential shifting to a next stage in response to the clock signal $\phi 1$. The clock signal $\phi 1$ is a clock signal which is produced four times per one channel time as has been described before with reference to FIGS. 2 and 3. In the shift register 526, therefore, 19-bit data is shifted four times per one channel time.

Among the 19-bit output from the shift register 526, low order 4 bits are applied to the full adder 523 and high order 15 bits are applied to the half adder 524. The accumulation of the output from the decoder 521 is made by this loop circuit. Among the 19-bit output from the shift register 526, high order 16 bits are applied to the selector 503 as the address for accessing a rhythm sound waveform in the waveform memory. For restricting the input to the selector 503 to 23 bits, low order 7 bits are all made "0".

When the rhythm read timing RT is "0", the selector 503 selects and outputs the input from the PCM address counter section 501 and, when the rhythm read timing RT is "1", the selector 503 selects and outputs the input from the rhythm address counter section 502. A 23-bit output from the selector 503 is applied to the adder 505 and added to 2-bit data provided by the interpolation counter 504.

When the rhythm read timing RT is "0", the interpolation counter 504 sequentially outputs "0", "1", "2" and "3" in decimal notation. Accordingly, with respect to one PCM address data produced by the selector 503, four consecutive addresses obtained by adding "0", "1", "2" and "3" to this PCM address data are provided. These four address data are added respectively to the start address in the adder 506 to provide final four address data for accessing the waveform memory.

On the other hand, the interpolation counter 504 produces "0" in decimal notation when the rhythm read timing RT is "1". Accordingly, the address data of the rhythm sound provided by the selector 503 is added to the start address in the adder 506 to provide final address data for accessing the waveform memory.

The above described interpolation counter 504 and other circuits are operated in accordance with the timing ($\phi 1$) at which the clock signal is produced four times per one channel time. Accordingly, as to address for generating a PCM tone waveform, four consecutive addresses are produced during one channel timing. As will be described later, these four addresses constitute addresses for four samples used for obtaining PCM waveform data by interpolation. As to a rhythm sound, address data is produced four times per one channel time. Address data of four rhythm sounds is produced during one channel timing.

Figure 6:
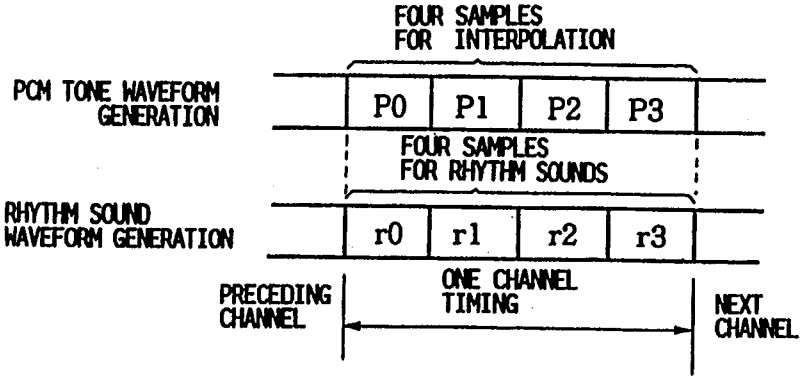
FIG. 6 is a time chart showing timing of address data provided from the read section.

FIG. 6 shows an output timing of address data from the read section 402. When the PCM tone waveform is generated, four address data p0, p1, p2 and p3 for accessing four samples for interpolation are sequentially generated during one channel timing. When the rhythm sound waveform is generated, four address data r0, r1, r2 and r3 for accessing rhythm sound samples for four rhythm sounds are sequentially produced during one channel timing.

In response to these address data, four consecutive sample data WSD as the PCM sample data read from the waveform memory 105 of FIG. 4 are sequentially applied to the interpolation section 403 during one channel timing whereas four sample data WSD for four sounds as the rhythm sound sample data are sequentially applied to the interpolation section 403 during one channel timing.

Figure 7:
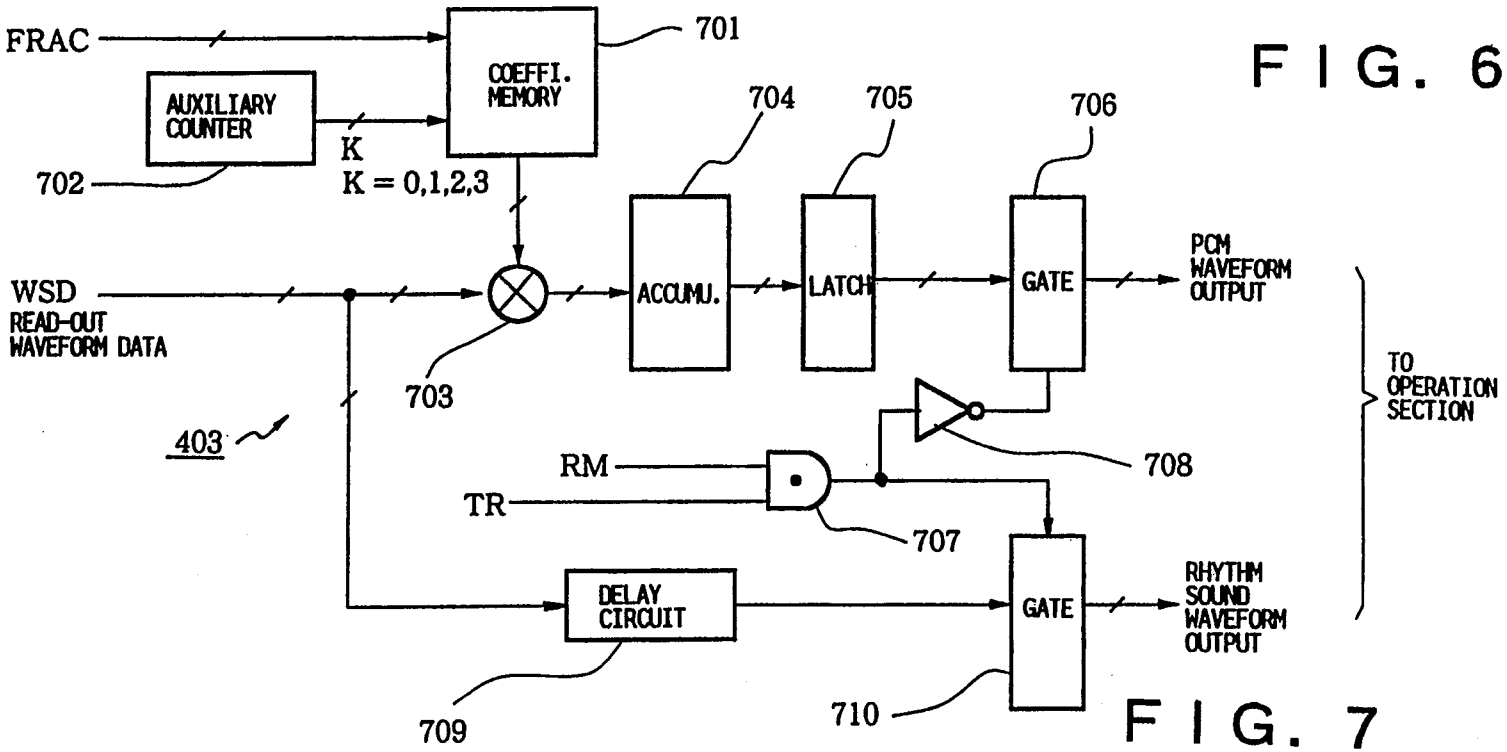
FIG. 7 is a block diagram showing an example of an interpolation section in FIG. 4.

Referring now to FIG. 7, description will be made about the interpolation section 403. The interpolation section 403 produces and outputs PCM waveform data by employing the known inserted interpolation method such as disclosed in U.S. Pat. No. 4,246,823 and also produces and outputs a rhythm sound waveform data after some delay. The interpolation section 403 includes a coefficient memory 701, an auxiliary counter 702, a multiplier 703, an accumulator 704, a latch 705, a gate 706, an AND gate 707, an inverter 708, a delay circuit 709 and a gate 710.

The coefficient memory 701 stores four coefficients A0(FRAC)–A3(FRAC) corresponding to values of various fraction sections FRAC. The auxiliary counter 702 produces k=0, 1, 2 and 3 in synchronism with the output timing of the four sample data WSD produced consecutively from the waveform memory 105. The coefficient memory 701 receives, as address signals therefor, the fraction section FRAC applied to its first input terminal and the coefficient value k (=0, 1, 2, 3) of the auxiliary counter 702 applied to its second input terminal and sequentially provides the four coefficients Ak(FRAC) in accordance with the values of these signals.

The multiplier 703 sequentially multiplies the four coefficients Ak(FRAC) sequentially provided by the coefficient memory 701 with the four sample data WSD provided consecutively from the waveform memory 105 and supplies results of the multiplication to the accumulator 704. The accumulator 704 accumulates the four results of the multiplication. The interpolation from the four samples is thereby executed. Upon completion of the accumulation using the four sample data, the accumulator 704 is cleared for next accumulation. The interpolated PCM waveform data provided by the accumulator 704 is latched by the latch 705 and provided through the gate 706.

The waveform data of a rhythm sound applied to the interpolation section 403 is delayed by a predetermined time by the delay circuit 709 and thereafter is delivered out through the gate 710. A predetermined value is set as the delay time of the delay circuit 709 and output of a rhythm sound is delayed by the same time as processing time for effecting interpolation of the PCM waveform so that the PCM waveform data and the rhythm sound waveform data are provided at the same timing.

The AND gate 707 ANDs the mode RM and the rhythm operation timing TR (see FIG. 2). When the mode RM is "1" and the rhythm operation timing TR is "1", i.e., when the mode is the rhythm mode and the timing is one for performing the operation for generating a rhythm sound, the AND gate 707 produces "1". This "1" output of the AND gate 707 opens the gate 710 and the interpolation section 408 thereby produces waveform data for the rhythm sound. The "1" output of the AND gate 707 is inverted by the inverter 708 to become "0" and thereby causes the gate 706 to close. At this time, therefore, the PCM waveform is not produced.

At other timing, the AND gate 707 produces "0". The "0" output of the AND gate 707 closes the gate 710 and, therefore, the waveform data of a rhythm sound is not produced. The "0" output of the AND gate 707 is inverted by the inverter 708 to become "0" and thereby causes the gate 706 to open. At this time, therefore, the PCM waveform data is produced.

Timings of these waveform data from the interpolation section 403 are shown in FIG. 3. That is, the line designated as "interpolated PCM waveform" of FIG. 3 illustrates a timing at which interpolated PCM waveform data of a particular channel is produced from the interpolation section 403. For example, PCM waveform data of the twenty-eighth channel is produced at a timing at which the channel time CHT is "0", PCM waveform data of the twenty-ninth channel is produced at a timing at which the channel time CHT is "1" and so on.

The line designated as "memory reading rhythm waveform" illustrates a timing at which rhythm sound waveform data is produced. As described above, the rhythm sound waveform generation processing during the rhythm mode is performed in the section of the thirty-first and thirty-second channels of PCM and, accordingly, waveform data of the rhythm sound is produced during the thirtieth and thirty-first channels of PCM. Reference characters r0, r1, . . . , r7 designate waveform data of the 0-th channel, first channel, . . . , seventh channel of the rhythm sound.

Figure 8:
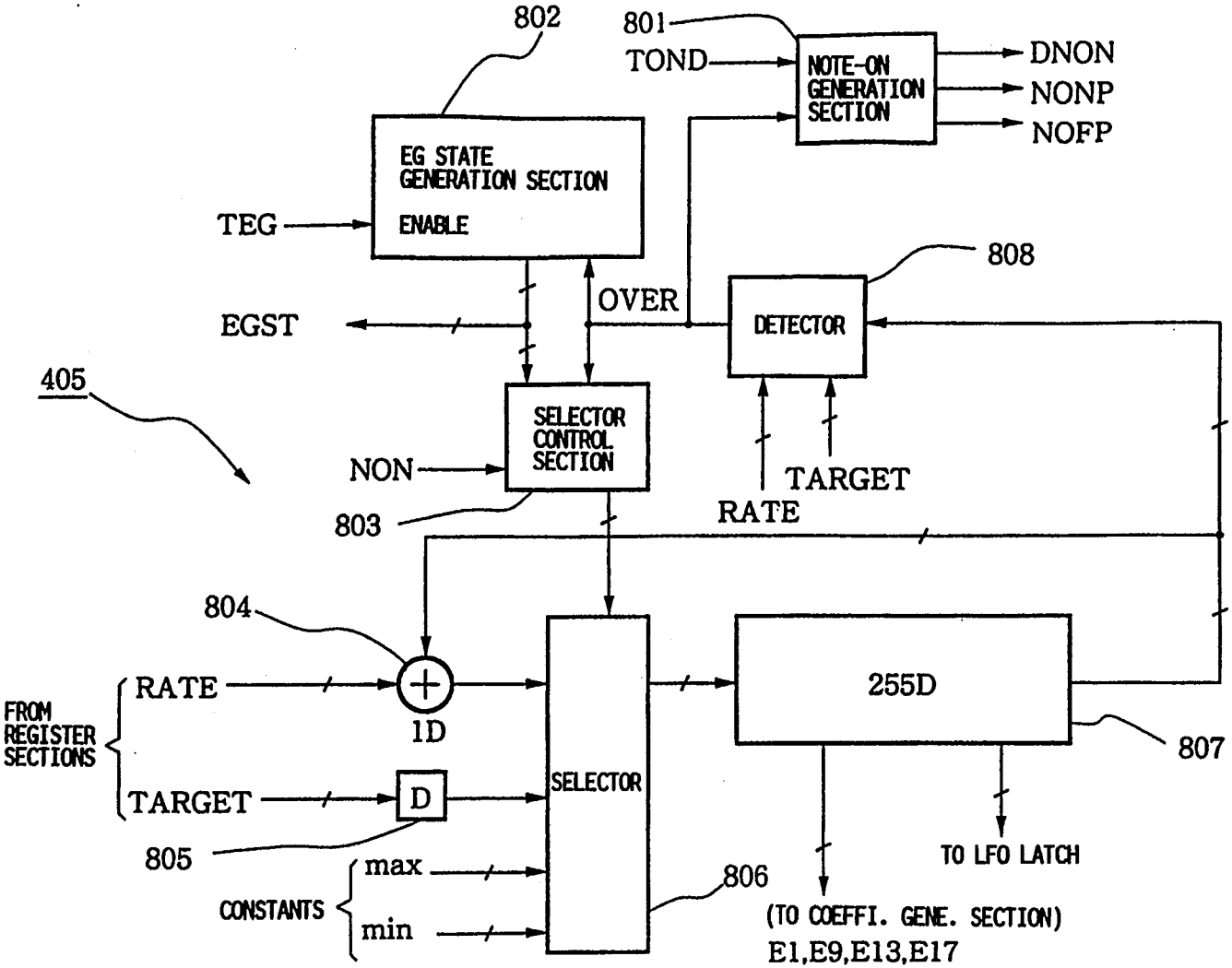
FIG. 8 is a block diagram showing an example of a multi-function envelope generator in FIG. 4.

Referring now to FIG. 8, the multi-function EG 405 of FIG. 4 will be described. The multi-function EG 405 includes a delay note-on DNON generation section 801, an EG state generation section 802, a selector control section 803, an adder 804, a delay circuit 805, a selector 806, a shift register 807 having 255 stages and a detector 808. The adder 804 receives the parameter RATE from the rate register section 116 of FIG. 1. The delay circuit 805 receives the parameter TARGET from the target register section 117 of FIG. 1.

Before describing the operation of the multi-function EG 405 in detail, description will be made about the structure of these register sections and parameters provided therefrom.

Figure 9:
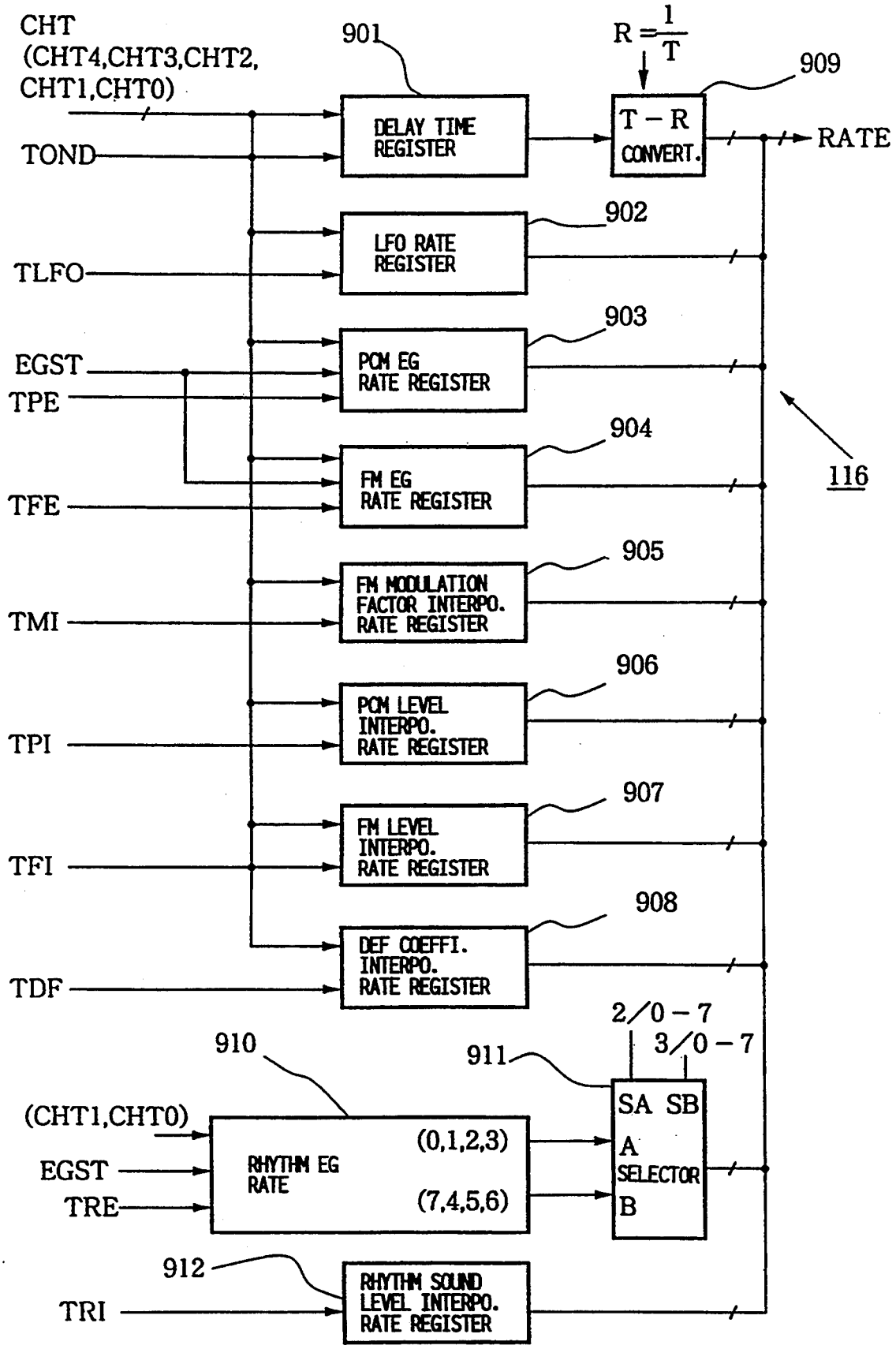
FIG. 9 is a block diagram showing an example of a rate register in FIG. 1.

FIG. 9 is a specific block diagram showing the rate register section 116 of FIG. 1. The rate register section 116 includes a delay time register 901, a T-R converter 909, an LFO rate register 902, a PCM EG rate register 903, an FM EG rate register 904, an FM modulation factor interpolation rate register 905, a PCM level interpolation rate register 906, an FM level interpolation rate register 907, a DCF coefficient interpolation rate register 908, a rhythm sound EG rate generation section 910, a selector 911 and a rhythm sound level interpolation rate register 912.

The delay time register 901 stores delay time T for determining a rate used when the EG 405 performs the note-on delay function. The LFO rate register 902 stores a rate of LFO when the EG 405 produces an LFO output. The PCM EG rate register 903 stores rates of envelope (i.e., attack rate, first decay rate, second decay rate and release rate) used when the EG 405 produces a PCM envelope. The FM EG rate register 904 stores rate of envelope (i.e., attack rate, first decay rate, second decay rate and release rate) used when the EG 405 produces an FM envelope.

The FM modulation factor interpolation rate register 905 stores an interpolation rate used when the EG 405 performs the FM modulation factor interpolation processing. The FM level interpolation rate register 907 stores an interpolation rate used when the EG 405 performs the FM level interpolation processing. The DCF coefficient interpolation rate register 908 stores an interpolation rate used when the EG 405 performs interpolation of a filter coefficient of the digital filter in the operation section.

The eight registers 901 to 908 respectively have storage area for the number of channels. The delay time register 901, for example, is an aggregate of 32 registers, i.e., a delay time register of the 0-th channel, a delay time register of the first channel, . . ., and a delay time register of the thirty-first channel. The same is the case with the other registers 902 to 908. However, the PCM EG rate register 903 and the FM EG rate register 904 store four rates, i.e., the attack rate, first decay rate, second decay rate and release rate, per storage area for one channel.

The 8 registers 901 to 908 respectively receive the channel time CHT (5 bits). These registers 901 to 908 also receive 8 timing signals generated by the timing generation section 120 of FIG. 2, i.e., the key-on delay timing signal TOND, LFO timing signal TLFO, PCM EG timing signal TPE, FM EG timing signal TFE, FM modulation factor level interpolation timing signal TMI, PCM level interpolation timing signal TPI, FM level interpolation timing signal TFI and filter coefficient processing timing signal TDF.

Data of the respective registers 901 to 908 is delivered out as the parameter RATE at timings at which these timing signals are generated in each channel.

For example, referring to FIG. 3, the key-on delay timing signal TOND of the twenty-eighth channel is generated at the timing of CHT=30 and SLT=0. At this timing, the LFO rate register 902 produces the LFO rate for the twenty-eighth channel. The produced LFO rate constitutes the parameter RATE.

Similarly, the LFO timing signal TLFO of the twenty-eighth channel is generated at the timing of CHT=30 and SLT=4. At this timing, the LFO register 902 produces the LFO rate for the twenty-eighth channel. The produced LFO rate constitutes the parameter RATE.

Since the PCM EG rate register 903 provides four rate data per one channel, it receives an EG state EGST for distinguishing the four data from one another. The EG state register EGST is a signal which is generated by an EG state generation section 802 in the EG 405 shown in FIG. 8. The EG state EGST indicates a waveform state in the envelope which is currently produced. More specifically, when the EG 405 is currently producing the waveform of the attack portion, the EG state EGST assumes a value "1". When the EG 405 is currently producing the waveform of the first decay portion, EGST is "2". When the EG 405 is currently producing the waveform of the second decay portion or the sustain portion (or no sound is generated), EGST is "3".

The PCM EG timing signal TPE of the twenty-eighth channel is generated at the timing of CHT=31 and SLT=0. At this timing and under the condition that EG state EGST is "0", the PCM EG rate register 903 produces the attack rate of the envelope in the twenty-eighth channel. Similarly, at the timing of the timing signal TPE and under the condition that EG state EGST is "1", "2" and "3" the PCM EG rate register 903 produces the first decay rate, second decay rate and release rate of the envelope in the twenty-eighth channel, respectively. These rate data produced are provided as the parameter RATE.

Timings at which the four rate data are provided from the FM EG rate register 904 are the same as those of the above described PCM EG rate register 903. The FM EG rate register 904, however, produces, as the parameter RATE, rate data corresponding to the EG state EGST at the timing at which the FM EG timing signal TFE is generated.

The other registers 905 to 908 produce, in the same manner as has been described with respect to the delay time register 901 and the LFO register 902, respective data as the parameter RATE at timings at which the respective timing signals are generated.

The rhythm sound EG rate generation section 910 receives low order 2 bits CHT0 and CHT1 of the channel time CHT, EG state EGST and rhythm EG timing TRE. The rhythm sound EG rate generation section 810 produces rhythm sound EG rate data at the timing of the rhythm EG timing TRE. Particularly, as shown in FIG. 3, at the timing at which the rhythm EG timing TRE is generated, the rhythm sound channel can be determined by the values of the low order 2 bits CHT0 and CHT1 of the channel time CHT in the following manner:

(1) When CHT0 is 0 and CHT1 is 0, CHT is either 0 or 4 and, accordingly, rhythm sound EG rate data to be produced is either data of the rhythm sound 0-th channel or the rhythm sound seventh channel.

(2) When CHT0 is 0 and CHT1 is 1, CHT is 0 or 4 and, accordingly, rhythm sound EG rate data to be produced is data of the rhythm sound first channel or rhythm sound fourth channel.

(3) When CHT0 is 1 and CHT1 is 0, CHT is 2 and, accordingly, the rhythm sound EG rate data to be produced is either data of the rhythm sound second channel or data of the rhythm sound fifth channel.

(4) When CHT0 is 1 and CHT1 is 1, CHT is 3 and, accordingly, the rhythm sound EG rate data to be produced is either data of the rhythm sound third channel or data of the rhythm sound sixth channel.

In response to the respective values of CHT0 and CHT1, the rhythm sound EG rate data of the rhythm sound 0-th, first, second or third channel is provided from the output terminal designated by "(0, 1, 2, 3)" and the rhythm sound EG rate data of the rhythm sound seventh, fourth, fifth or sixth channel is provided from the output terminal designated by "(7, 4, 5, 6)". These outputs are applied respectively to terminals A and B of the selector 911. When the slot time SLT is "2" (i.e., at the C slot in FIG. 3), the selector 911 selects and outputs the input at the terminal A and, when the slot time SLT is "3" (i.e., at the D slot in FIG. 3), the selector 911 selects and outputs the input at the terminal B. Accordingly, when the timing signals of the respective channels for generation of the rhythm sound described with reference to FIG. 3 are generated, the rhythm sound EG rate data of the corresponding channels are provided as the parameter RATE.

The rhythm sound EG rate data thus produced are four rate data per rhythm sound one channel. For distinguishing the four rate data from one another, the EG state EGST is applied. More specifically, when the waveform of the attack portion of a rhythm sound is currently produced, EGST is "0". At this time, the rhythm sound EG rate generation section 910 produces the attack rate of the envelope of the rhythm sound. Similarly, when the waveform of the first decay portion of the rhythm sound is produced, EGST is "1". When the waveform of the second decay portion of the rhythm sound is produced, EGST is "2". When the waveform of the release portion of the rhythm sound is produced (or no sound is produced), EGST is "3". The rhythm sound EG rate generation section 910 correspondingly produces the first decay rate, second decay rate and release rate of the rhythm sound envelope.

The rhythm sound level interpolation rate register 912 stores the rate for performing the level interpolation of a rhythm sound. The level interpolation of a rhythm sound is made by using a value which is common to the 8 rhythm sound channels. An arrangement is made, therefore, so that, at the timing of the rhythm sound interpolation timing signal TRI, the value stored in the rhythm sound level interpolation rate register 912 is provided as the parameter RATE.

Figure 10:
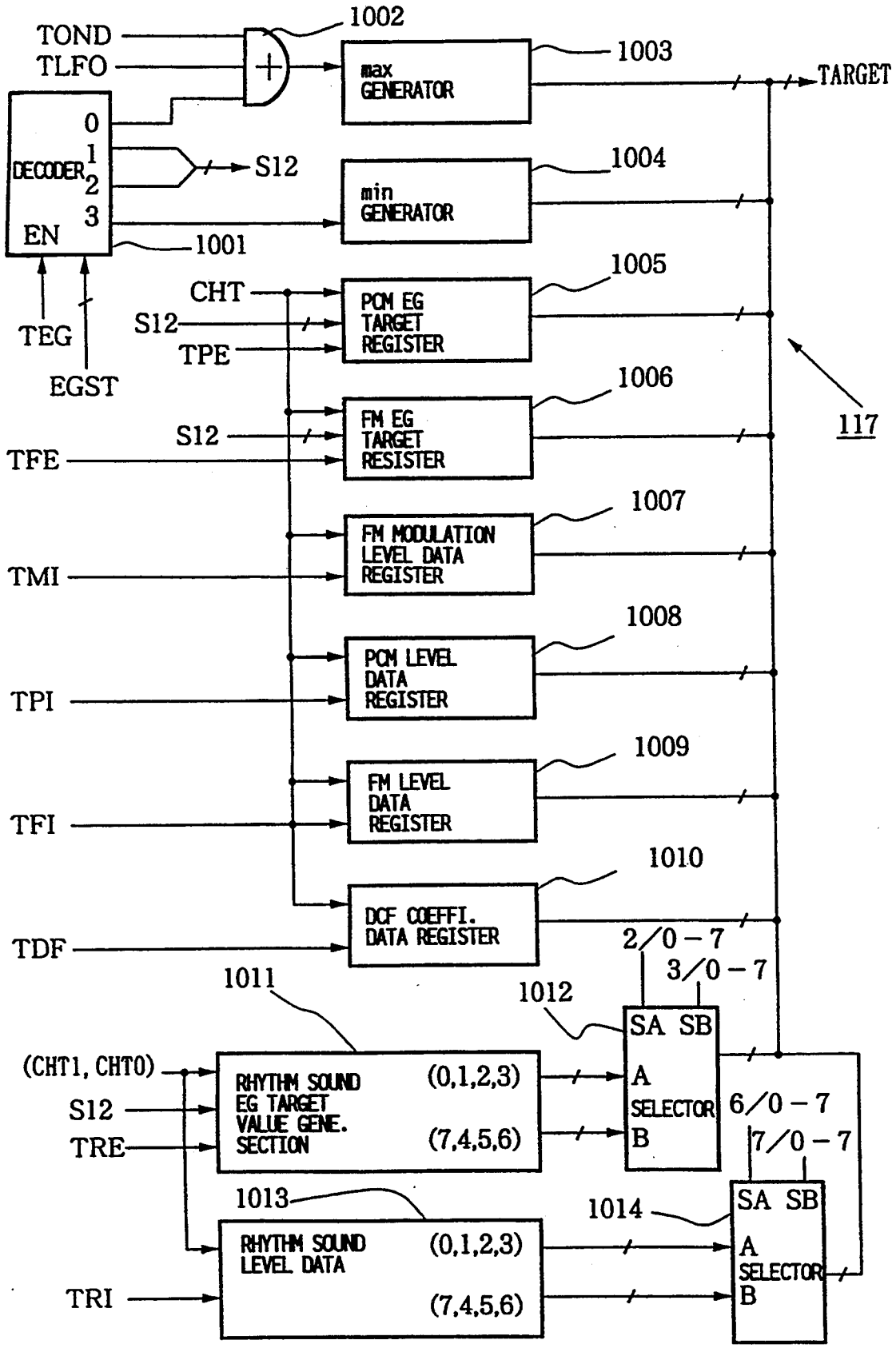
FIG. 10 is a block diagram showing an example of a target register in FIG. 1.

Then, referring to FIG. 10, description will be made about the target register section 117 shown in FIG. 1. The target register section 117 includes a decoder 1001, an OR gate 1002, a max. (maximum value) generator 1003, a min. (minimum value) generator 1004, a PCM EG target register 1005, an FM EG target register 1006, an FM modulation level data register 1007, a PCM level data register 1008, an FM level data register 1009, a DCF coefficient data register 1010, a rhythm sound EG target value generation section 1011, a selector 1012, a rhythm sound level data register 1013 and a selector 1014.

The max. generator 1003 stores a target value when the EG 405 performs the note-on delay function, a target value when the EG 405 generates LFO and a target value when EG 405 generates a waveform of a release portion of a PCM envelope. Since the same value is used for the target values stored in the max. generator 1003 of all channels and the same value is used for the target values stored in the min. generator 1004 of all channels, these generators respectively have a single storage area.

To the OR gate 1002 are applied the key-on delay timing signal TOND, LFO timing signal TLFO and an output signal from the 0-th output terminal of the decoder 1001. The decoder 1001 receives the EG operation timing signal TEG and also the EG state EGST. At the EG operation timing, the decoder 1001 provides "1" at the 0-th, first, second and third output terminals (i.e., output terminals designated by "0", "1", "2" and "3" in the decoder 1001) in response to the value of the EG state EGST (i.e., "0", "1", "2" and "3"). Therefore, at the timing at which the attack portion of the envelope is produced, the 0-th output terminal of the decoder 1001 becomes "1". At the timing of the first decay portion, the first output terminal becomes "1". At the timing of the second decay portion, the second output terminal becomes "1". At the timing of the release portion, the third output terminal becomes "1". Otherwise, these output terminals are "0".

Thus, the OR gate 1002 supplies "1" to the max generator 1003 at timings at which the EG 405 performs the note-on delay function, the LFO outputting function and outputs the attack portion of the envelope. In response thereto, the max. generator 1003 generates a constant which becomes a target value in the execution of these functions and supplies it as a parameter TARGET.

To the min. generator 1004 is applied the output of the third output terminal of the decoder 1001. At the timing of input of this signal, i.e., at the timing at which the EG 405 generates the release portion of the envelope, the min. generator 1004 generates a constant which becomes a target value of the release waveform and provides it as the parameter TARGET.

The six registers 1005 to 1010 respectively have storage areas corresponding to the number of channels. For example, the PCM EG target register 1005 is an aggregate of 32 storage areas, i.e., a storage area for storing a target value of the 0-th channel, a storage area for storing a target value of the first channel, . . ., a storage area for storing a target value of the thirty-first channel. The same is the case with the other registers 1006 to 1010.

The PCM EG target register 1005 and the FM EG target registers 1006 respectively store two target values in a storage area for one channel, i.e., first decay level which is a target value of the first decay portion and second decay level which is a target value of the second decay portion. The FM modulation level data register 1007, PCM level data register 1008, FM level data register 1009 and DCF coefficient data register 1010 respectively store one target value in each storage area for one channel.

The channel time CHT (5 bits) is applied to the six registers 1005 to 1010. To the six registers 1005 to 1010 are also applied the six timing signals generated in the timing generation section 120, i.e., the PCM EG timing signal TPE, the FM EG timing signal TFE, the FM modulation factor level interpolation timing signal TMI, the PCM level interpolation timing signal TPI, the FM level interpolation timing signal TFI and the filter coefficient processing timing signal TDF.

At timings at which these timing signals in the respective channels are generated, data stored in the registers 1005 to 1010 are provided as the parameter TARGET.

Since two target value data per one channel are read from the PCM EG target register 1005, an output signal S12 (2 bits) is applied to the register 1005 from the first and second output terminals of the decoder 1001 for distinguishing the two target values from each other. By this output signal S12, whether the EG 405 is producing the first decay portion or the second decay portion of the envelope is detected. The PCM Eg target register 1005 produces the first decay level when the first decay portion output is detected and the second decay level when the second decay portion output is detected.

To the rhythm sound EG target value generation section 1011 are applied low order 2 bits CHT0 and CHT1, the output signal S12 of the decoder 1001 and the rhythm EG timing TRE. The rhythm sound EG target value generation section 1011 produces EG target value data of a rhythm sound at the timing of the rhythm EG timing TRE. The manner of generation of this data is the same as that of the rhythm sound EG rate generation section 910 and the selector 911 in FIG. 9. In response to the respective CHT0 and CHT1, the rhythm sound EG target value data of the rhythm sound 0-th, first, second or third channel is provided from the output terminal designated as "(0, 1, 2, 3)" and the rhythm sound EG target value data of the rhythm sound seventh, fourth, fifth or sixth channel is provided from the output terminal designated as "(7, 4, 5, 6)". These outputs are applied to terminals A and B of the selector 1012. The selector 1012 selects and outputs the input at the terminal A when the slot time SLT is "2" (i.e., at the C slot in FIG. 3) and selects and outputs the input at the terminal B when the slot time SLT is "3" (i.e., at the D slot in FIG. 3). When, therefore, the timing signals of the respective channels are generated for generation of a rhythm sound as described with reference to FIG. 3, rhythm sound EG target value data of corresponding channels are provided as the parameter TARGET.

The rhythm sound EG target value data thus produced are two target value data for one channel of rhythm sound. For distinguishing these target value data from each other, the output signal S12 of the decoder 1001 is applied. That is, when a waveform of the first decay portion of a rhythm sound is currently produced, the rhythm sound EG target value generation section 1011 produces the first decay level of the envelope of the rhythm sound. Similarly, when a waveform of the second decay portion of the rhythm sound is currently produced, the rhythm sound EG target value generation section 1011 produces the second decay level of the envelope of the rhythm sound.

The rhythm sound level data register 1013 stores levels of a rhythm sound of the respective channels. An arrangement is made so that, at the timing of the rhythm sound interpolation timing signal TRI, data stored in this rhythm sound level data register 1013 is provided as the parameter TARGET. The manner in which this register 1013 cooperates with the selector 1014 is the same as in the case of the rhythm sound EG target value generation section 1011 and the selector 1012 so that description in detail will be omitted. Since, however, rhythm sound level data produced is one for each channel, the output signal S12 is not applied to the rhythm sound level data register 1013.

The functions of the multi-function EG 405 will now be described in detail with reference to FIGS. 11 to 14.

Figure 11:
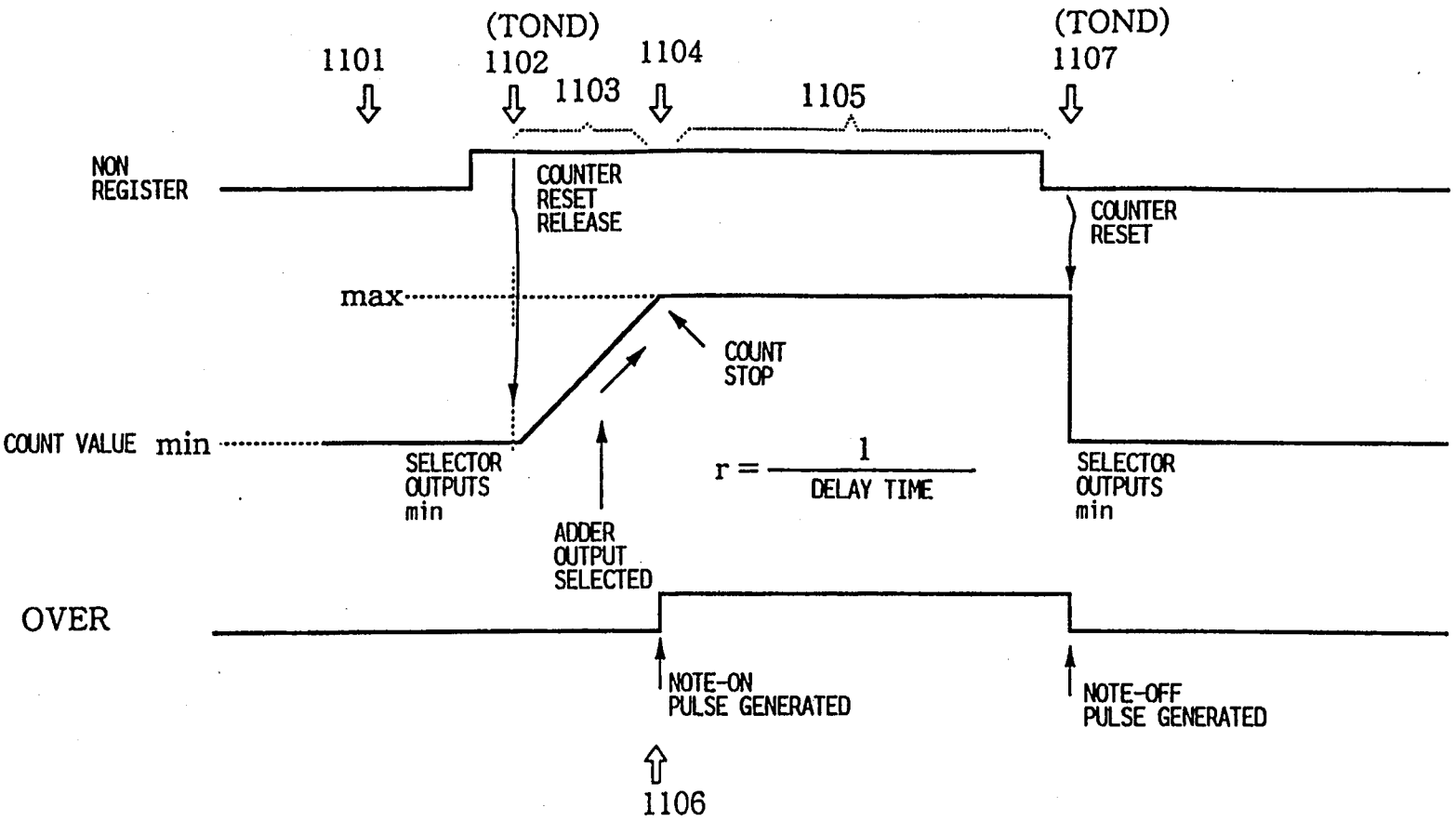
FIG. 11 is a diagram for explaining a note-on delay function performed by the envelope generator.

FIG. 11 is a diagram for explaining the note-on delay function of the multi-function EG 405. In the figure, "COUNT VALUE" shows data which is currently processed by the EG 405. Specifically, it is a value of the final stage of the shift register 807 of the EG 405 which is applied to the adder 804 and detector 808.

Referring to FIG. 8, the shift register 807 having 255 stages performs shifting in accordance with the clock signal $\phi 0$. Accordingly, summing data of the shift register 807 and data of the adder 804 which is a one-stage delay circuit connected to the final stage of the shift register 807 together, data of 256 clocks (in $\phi 0$) counting retrospectively from the present time point is stored. As shown in FIG. 3, this data is a series of data corresponding to the respective functions of the 0-th to thirty-first channels (8 for each channel).

Referring to FIG. 11, at a timing of the key-on delay timing signal TOND of a certain channel, the EG 405 refers to the NON register (FIG. 1, reference character 113) of this channel. While the NON register is "0" (e.g., position of reference character 1101), the selector control section 803 controls the selector 806 so that the selector 806 selects and outputs the constant min (minimum value). The selector 806 thereby causes the constant min to be written as the current count value in the first stage of the shift register 807. Then, a key of the keyboard 101 is depressed and a certain channel is thereby assigned and the NON register of this channel becomes "1".

Upon turning of the NON register to "1", the selector control section 803 controls the selector 807, at the timing of the key-on delay timing signal TOND of this channel, so that the selector 807 selects and outputs an input from the adder 804 (reference character 1102). At this time, as has been described with reference to FIGS. 9 and 10, the rate R (=1/delay time T) is applied as the parameter RATE and the constant max which constitutes a target value is applied as the parameter TARGET respectively to the EG 405. The adder 804, therefore, performs a processing for adding the rate R to the constant min which is the minimum value which has already been written. Result of the addition in the adder 804 is written in the shift register 807 through the selector 807.

Upon further increment of clock and arrival of next timing of the key-on delay timing signal TOND of this channel, while the NON register is "1", the rate R is likewise added to corresponding data stored in the shift register 807 and result of the addition is written in the shift register 807. In this manner, the stored data (count value) of the shift register 807 is accumulated (i.e., counted up at the rate R) (reference character 1103).

In the meanwhile, the parameter TARGET (constant max) which constitutes a target value is applied to the detector 808 which compares the value of the final stage of the shift register 807 applied to the adder 804 and the target value TARGET. When the value of the final stage of the shift register 807 has reached the target value TARGET (reference character 1104), a detection signal OVER rises from "0" to "1". In response to rising of this detection signal OVER, the selector control section 803 controls the selector 806 to select and output the constant max (maximum value). Subsequently, therefore, the constant max is maintained as the stored data of the shift register 807 until detection of turning of the NON register to "0" (reference character 1105).

The detection signal OVER is applied also to the DNON generation section 801. The DNON generation section 801 produces the no re-on pulse NONP at the timing of rising of the detection signal OVER (reference character 1106). The DNON generation section 801 provides also the detection signal OVER directly as the delay note-on DNON.

Then, upon releasing of the depressed key in the keyboard 101, the NON register of the channel to which the depressed key has been assigned becomes "0". Upon turning of the NON register to "0", the selector control section 803 controls, at the timing of the key-on delay timing signal TOND of this channel, the selector 807 to select and output the constant min (minimum value) (reference character 1107). The detector 808 causes the detection signal OVER to fall to "0" and produces the note-off pulse NOFP at the timing of falling of the signal OVER.

When the EG 405 performs the note-on delay function, the EG 405 performs the following operation.

Figure 12:
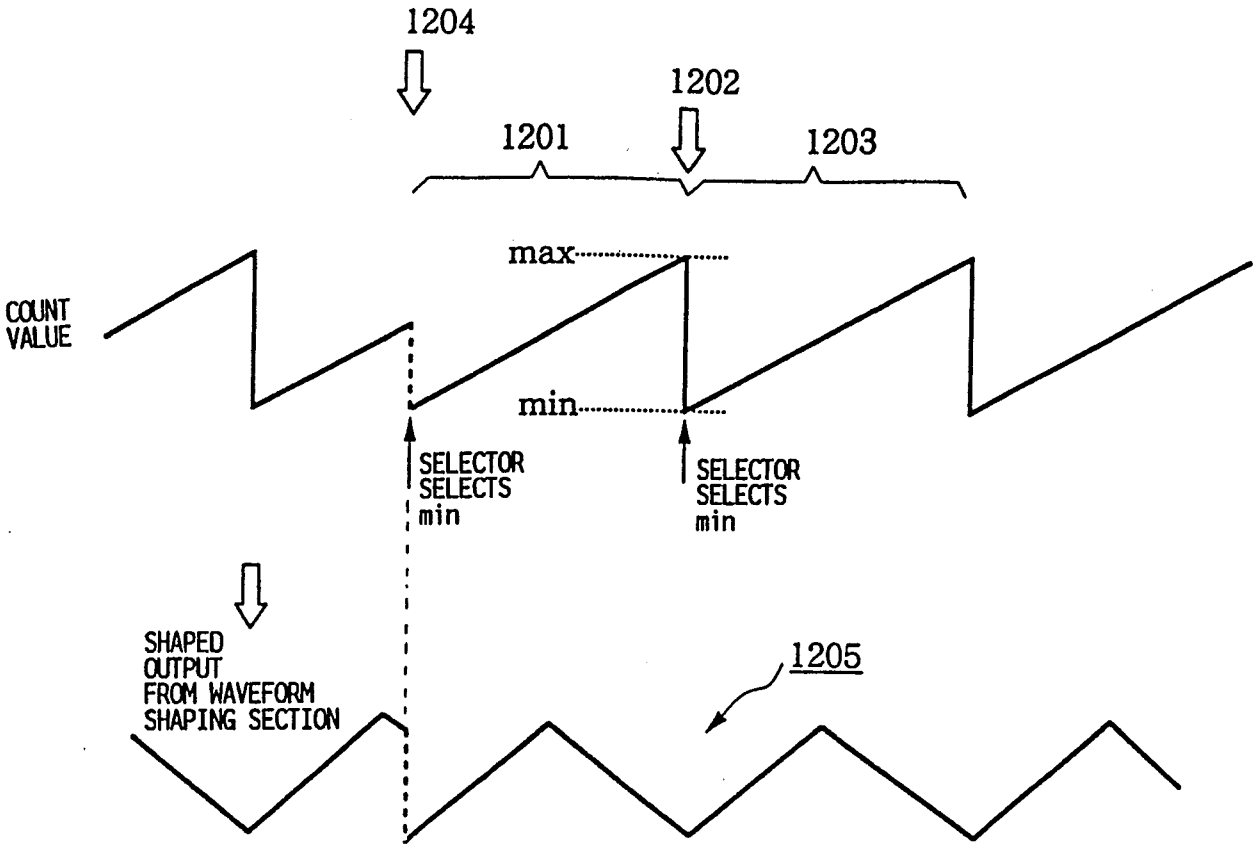
FIG. 12 is a diagram for explaining a low frequency signal waveform generation function of the envelope generator.

FIG. 12 is a diagram for explaining the LFO waveform generation function of the multi-function EG 405. Referring to FIG. 12, the selector control section 803 of the EG 405 controls the selector 807, at the timing of the LFO timing signal TLFO of each channel, so that the selector 807 selects and outputs an input from the adder 804. At this time, the LFO rate is applied to the EG 405 as the parameter RATE. The adder 804, therefore, performs a processing for adding the LFO rate to the value which has already been written. Result of the addition in the adder 804 is written in the shift register 807 through the selector 806.

Upon further increment of clock and arrival of next timing of the LFO timing signal TLFO of this channel, the LFO rate is likewise added to the value which has already been stored in the shift register 807 and result of the addition is written in the shift register 807. In this manner, the stored data in the shift register 807 is accumulated (counted up at the LFO rate) (reference character 1201).

In the meanwhile, the constant max is applied as the parameter TARGET which constitutes a target value to the detector 808. The detector 808 compares the value of the final stage of the shift register 807 applied to the adder 804 with the target value TARGET. When the value of the final stage of the shift register 807 has reached the target value TARGET (reference character 1202), the detection signal OVER rises from "0" to "1". In response to this detection signal OVER, the selector control section 803 controls the selector 806 to select and output the constant min (minimum value). Subsequently, therefore, the accumulation of the LFO rate is resumed with this minimum value min being used as an initial value (reference character 1203). At the timing of the LFO output, the above described operation is basically repeated.

In the meanwhile, when a certain key in the keyboard 101 has been depressed and the note-on pulse NONP has thereupon been generated, the selector control section 803 detects this pulse and controls the selector 806 to select and output the constant min (minimum value) (reference character 1204). Accordingly, the LFO output is initialized to the minimum value min by the note-on pulse NONP also and the accumulation of the LFO rate is subsequently resumed.

When the EG 405 performs the LFO waveform generation function, the EG 405 performs the following operation. The LFO waveform thus produced is delivered out of the shift register 807 at a predetermined timing and is latched by the LFO latch 406 of FIG. 4. The waveform then is shaped by the waveform shaping sections 407 and 408 and used for amplitude modulation and pitch modulation. FIG. 12 shows also a waveform 1205 after rectification by the waveform shaping sections 407 and 408. The waveform rectification in the waveform shaping sections 407 and 408 is a processing in which the most significant bit of the LFO latch 406 is referred to and all bits are inverted when the most significant bit is "1".

Figure 13:
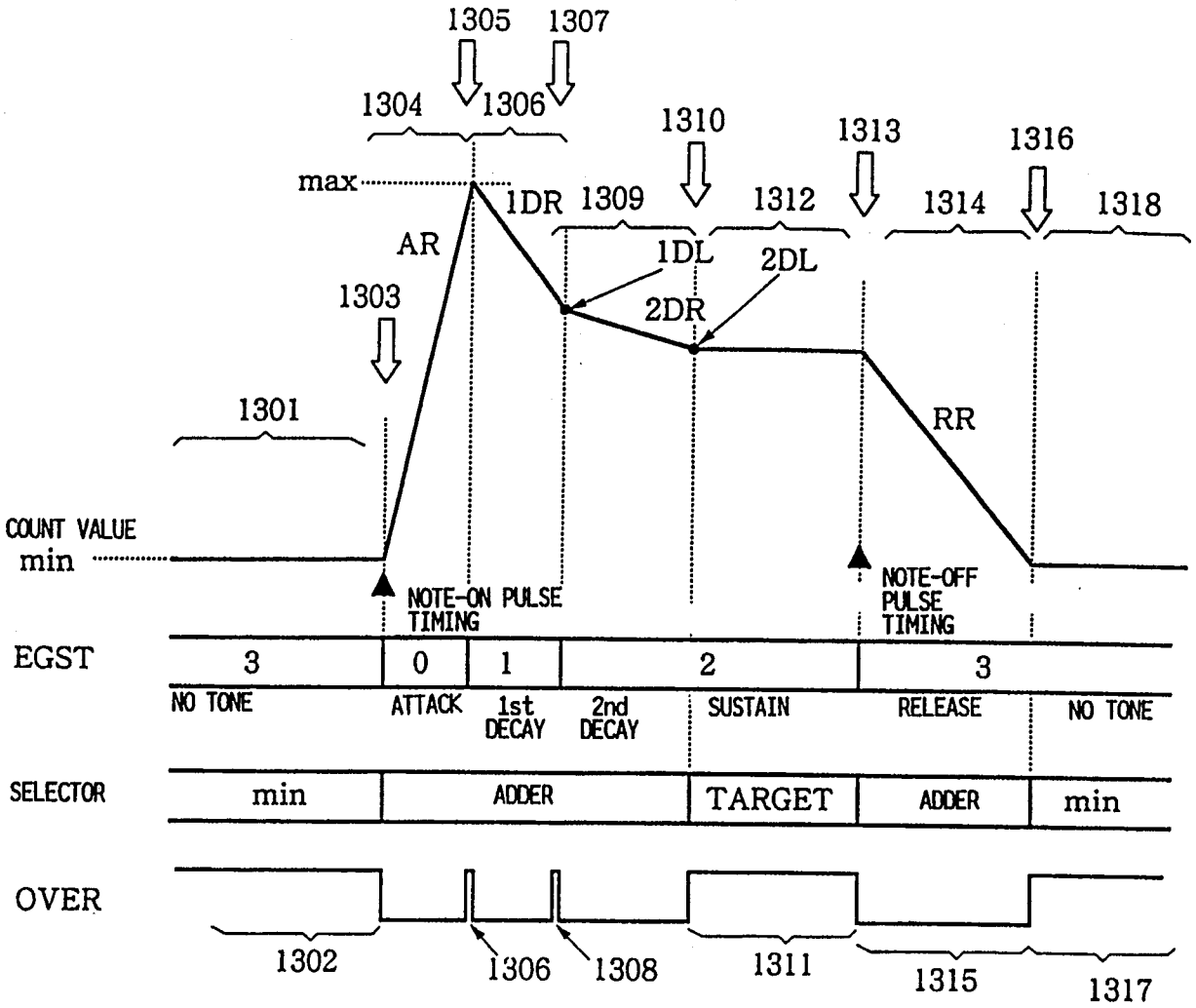
FIG. 13 is a diagram for explaining an envelope waveform generation function of the envelope generator.

FIG. 13 is a diagram for explaining the envelope shape generation function of the multi-function EG 405. There are three types of envelopes generated by the EG 405. They are a PCM envelope generated at the timing of the PCM EG timing signal TPE, an FM envelope generated at the timing of the FM EG timing signal TFE, and a rhythm sound envelope generated at the timing of the rhythm sound EG timing signal TRE.

First, by way of example, generation of the PCM envelope will be described. Referring to FIG. 13, when, at the timing of the EG timing signal TPE of a certain channel, the current state is one in which no tone is generated (EG state EGST=3), the selector control section 803 of the EG 405 controls the selector 807 to select and output the constant min (minimum value). At this time, the parameter TARGET applied to the detector 808 is the constant min for the minimum value. The detector 808, therefore, produces a signal "1" as the detection signal OVER (reference character 1302).

Then, when a certain key in the keyboard 101 has been depressed and the note-on pulse NONP has thereupon been generated, the EG state generator 802 turns, responsive to the note-on pulse NONP, the EG state EGST to "0" (i.e., an attack portion output state) and the selector control section 803 detects this state and controls the selector 806 to select and output an input from the adder 804 (reference character 1303). Upon turning of the EG state EGST to "0", as has been described with reference to FIGS. 9 and 10, the attack rate AR is applied as the parameter RATE and the constant max (maximum value) which constitutes a target value is applied as the parameter TARGET respectively to the EG 405.

The adder 804 therefore performs a processing for adding the attack rate AR to the constant min for the minimum value which has already been written. Result of the addition in the adder 804 is written in the shift register 807 through the selector 806. Since the parameter TARGET applied to the detector 808 becomes the constant max (maximum value), the detection signal OVER becomes "0".

Upon increment of the clock and arrival of the timing of the PCM tone source EG timing signal TPE of this channel, the attack rate AR is likewise added to the current value stored in the shift register 807 and result of the addition is written in the shift register 807. In this manner, the stored data in the shift register 807 is accumulated (counted up at the attack rate AR) (reference character 1304). The waveform of the attack portion of the envelope is thereby produced.

In the meanwhile, when the count which is thus accumulated has reached the target value TARGET (constant max) (reference character 1305), the detector 808 produces a signal "1" as the detection signal OVER. The EG state generation section 802 receives this detection signal OVER and turns the EG state EGST from "0" to "1" (a first decay portion output state). Upon turning of the EG state EGST to "1", as has been described with reference to FIGS. 9 and 10, the first decay rate 1DR is applied as the parameter RATE and the first decay level 1DL which constitutes a target value is applied as the parameter respectively to the EG 405.

The detector 808 therefore compares the count (which has reached the constant max at this time point) with the first decay level 1DL and the detection signal OVER becomes "0" (reference character 1306). The selector control section 803 controls the selector 806 to continuously select and output an input from the adder 804. Subsequently, therefore, the first decay rate 1DR is accumulated with the maximum value max being used as an initial value and the waveform of the first decay portion of the envelope is thereby produced (reference character 1306). Since the first decay rate 1DR is a negative number, the waveform of the first decay portion assumes a curve which gradually attenuates as shown in the figure.

When the count which is thus accumulated has reached the target value TARGET, i.e., the first decay level 1DL (reference character 1307), the detector 808 produces "1" as the detection signal OVER. The EG state generation section 802 receives this detection signal OVER and thereby turns the EG state EGST from "1" to (a second decay portion output state). Upon turning of the EG state EGST to "2", as has been described with reference to FIGS. 9 and 10, the second decay rate 2DR is applied as the parameter RATE and the second decay level which constitutes a target value is applied as the parameter TARGET respectively to the EG 405.

The detector 808 therefore compares the count (which has reached the first decay level 1DL at this time point) with the second decay level 2DL and the detection signal OVER becomes "0" (reference character 1308). The selector control section 808 controls the selector 806 to continuously select and output an input from the adder 804. Subsequently, therefore, the second decay rate 2DR is accumulated with the first decay level 1DL being used as an initial value and the waveform of the second decay portion is thereby produced (reference character 1309). Since the second decay rate 2DR is a negative number, the waveform of the second decay section assumes a curve which gradually attenuates as shown in the figure.

When the count which is thus accumulated has reached the target value TARGET, i.e., the second decay level 2DL (reference character 1310), the detector 808 produces a signal "1" as the detection signal OVER. The EG state generation section 802 receives this detection signal OVER but retains the EG state EGST at "2". At this time, the second decay rate 2DR is applied as the parameter RATE and the second decay level 2DL which constitutes a target value is applied as the parameter TARGET respectively to the EG 405.

The detector 808 therefore compares the count (which has reached the second decay level 2DL at this time point) with the second decay level 2DL and continues to produce "1" as the detection signal OVER (reference character 1311). The selector control section 803 controls the selector 806 to select and output the input of the parameter TARGET through the one stage delay circuit 805. Subsequently, therefore, the second decay level 2DL is retained as the count and the waveform of the sustain portion of the envelope is thereby produced (reference character 1312).

Then, when the depressed key in the keyboard 101 has been released and the note-off pulse NOFP has thereupon been generated (reference character 1313), the EG state generator 802 turns the EG state EGST from to "3" (a release portion output state) in response to the note-off pulse NOFP. The selector control section 803 detects this state and controls the selector 806 to select and output an input from the adder 804. Upon turning of the EG state EGST to "3", as has been described with reference to FIGS. 9 and 10, the release rate RR is applied as the parameter RATE and the constant min (minimum value) which constitutes a target value is applied as the parameter TARGET respectively to the EG 405.

Subsequently, therefore, the release rate RR is accumulated with the second decay level 2DL being used as an initial value and the waveform of the release portion of the envelope is thereby produced (reference character 1314). Since the release rate is a negative number, the waveform of the release portion assumes a curve which gradually attenuates as shown in the figure. Since the parameter TARGET applied to the detector 808 becomes the constant min (minimum value), the detection signal OVER becomes "0" (reference character 1315).

When the count which is thus accumulated has reached the target value TARGET, i.e., the constant min (reference character 1316), the detector 808 produces "1" as the detection signal OVER. The EG state generation section 802 receives this detection signal OVER but retains the EG state EGST at "3". At this time, the constant rain is continuously applied to the EG 405 as the parameter TARGET. The detector 808, therefore, compares the count (which has reached the constant min which is the target value at this time point) with the constant min and continues to produce "1" as the detection signal OVER (reference character 1317). The selector control section 803 controls the selector 806 to select and output the input of the constant min for the minimum value. Subsequently, therefore, the constant min for the minimum value is maintained as the count and no sound state thereby is continued (reference character 1318).

In the foregoing, the operation of the EG 405 in generating the PCM envelope has been described. Since generation of the FM envelope at the timing of the FM tone source EG timing signal TFE and generation of the rhythm sound envelope at the timing of the rhythm sound EG timing signal TRE are made similarly, description thereof will be omitted.

Figure 14:
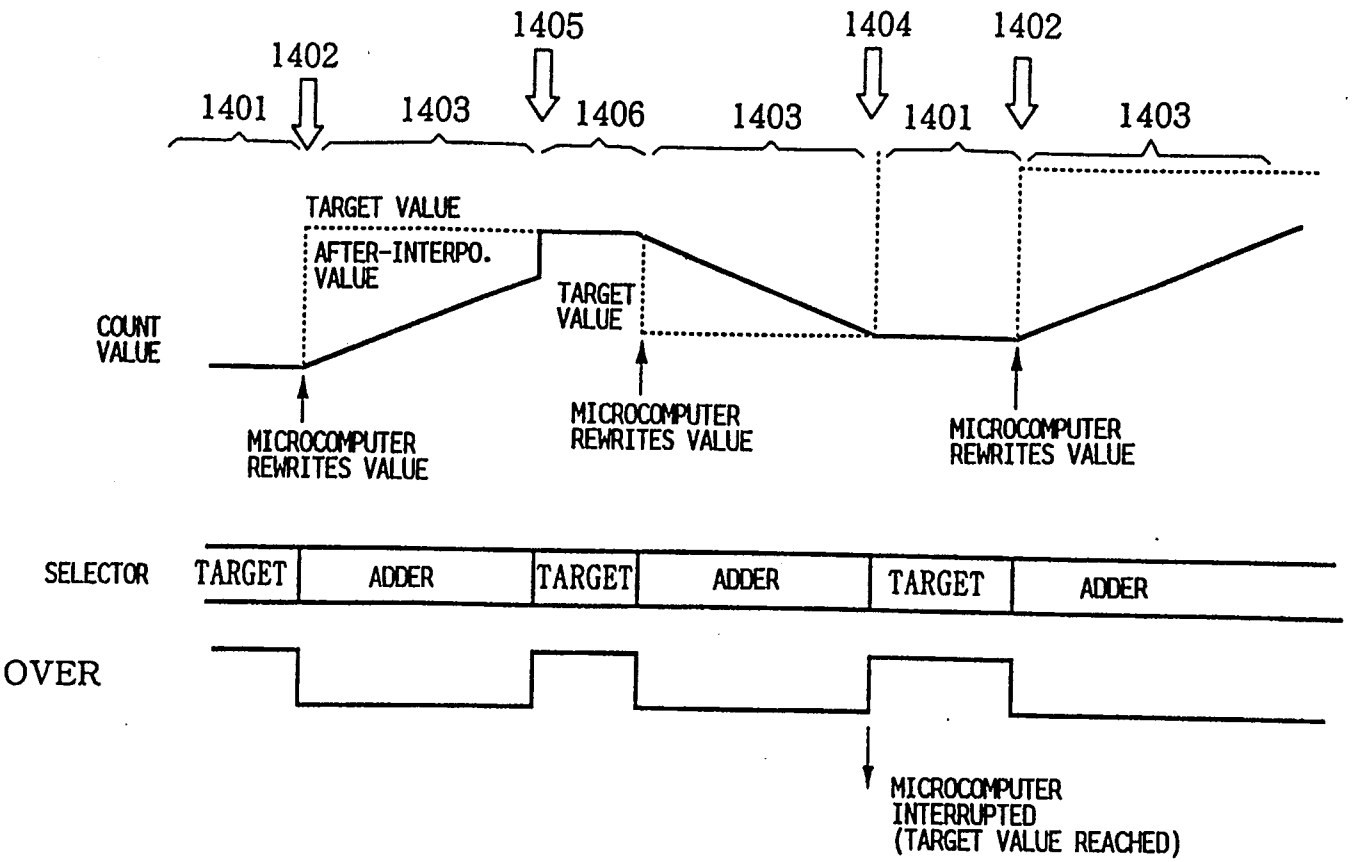
FIG. 14 is a diagram for explaining an interpolation function of the envelope generator.

FIG. 14 is a diagram for explaining the interpolation function of the multi-function EG 405. There are five types of interpolation functions performed by the EG 405. They are interpolation processings executed at generation of the FM modulation factor level interpolation timing signal TMI, PCM level interpolation timing signal TPI, FM level interpolation timing signal TFI, filter coefficient processing timing signal TDF and rhythm sound interpolation timing signal TRI. Since the operation of the EG 405 is the same whichever interpolation processing may be executed, the FM modulation factor level interpolation processing will be described by way of example and description of the other interpolation processings will be omitted.

Referring to FIG. 14, the detector 808 of the EG 405 compares, at the timing of the FM modulation factor level interpolation timing signal TMI of a certain channel, a count with a target value TARGET. As the target value TARGET, data stored in a modulation level data register 1007 of the target register section 117 is produced. When the count coincides with the target value TARGET (reference character 1401), the detector 808 produces "1" as the detection signal OVER and the selector control section 803 controls the selector 806 to select and output the input of the parameter TARGET through the one-stage delay circuit 805. Therefore, the value of the parameter TARGET is maintained as the count (reference character 1401).

Then, it is assumed that the microcomputer 103 has rewritten the value (target value) of the modulation level data register 1007 of the target register section 117 (reference character 1402). At this time, the detector 808 produces "0" as the detection signal OVER because the count is different from the target value TARGET and the selector control section 803 therefore controls the selector 806 to select and output an input from the adder 804. As the parameter RATE, the value of the FM modulation factor interpolation rate register 905 is applied. The adder 804, therefore, adds this FM modulation factor interpolation rate RATE to the count. Result of the addition by the adder 804 is written in the shift register 807 through the selector 806.

Upon increment of the clock and arrival of the timing factor level interpolation of the FM modulation timing signal TMI of this channel, the FM modulation factor interpolation rate is likewise added to the count stored in the shift register 807 and result of the addition is written in the shift register 807. In this manner, the stored data (count) in the shift register 807 is accumulated. It is assumed that the parameters RATE and TARGET are selected in such a manner that the rate RATE gradually approaches the target value TARGET by sequential accumulation of the rate RATE.

In the meanwhile, when the count which is thus accumulated has reached the target value TARGET (reference character 1404), the detector 808 produces "1" as the detection signal OVER. At this time, the FM modulation factor interpolation rate is applied as the parameter RATE and the modulation level which constitutes a target value is applied as the parameter TARGET continuously to the EG 405.

The detector 808 therefore compares the count (which has already reached the value of the target modulation level) with the target value of the modulation level and continues to produce "1" as the detection signal OVER. The selector control section 803 controls the selector 806 to select and output the input of the parameter TARGET through the one-stage delay circuit 805. Subsequently, therefore, the target value of the modulation level is maintained as the count (reference character 1401). When the count has reached the target value TARGET, interruption occurs in the microcomputer 103. The microcomputer 103 thereby knows that the count has reached the target value TARGET.

When a certain key in the keyboard 101 has been depressed and the note-on pulse NONP has thereby been generated (reference character 1405), the selector control section 803 controls the selector 806 to select and output the input of the parameter TARGET through the one-stage delay circuit 805. The target value TARGET therefore is written compulsorily as the count. The detector 808 produces "1" as the detection signal OVER and the target value of the modulation level is maintained as the count (reference character 1406).

In the foregoing manner, the EG 405 performs the FM modulation factor level interpolation processing.

Figure 15:
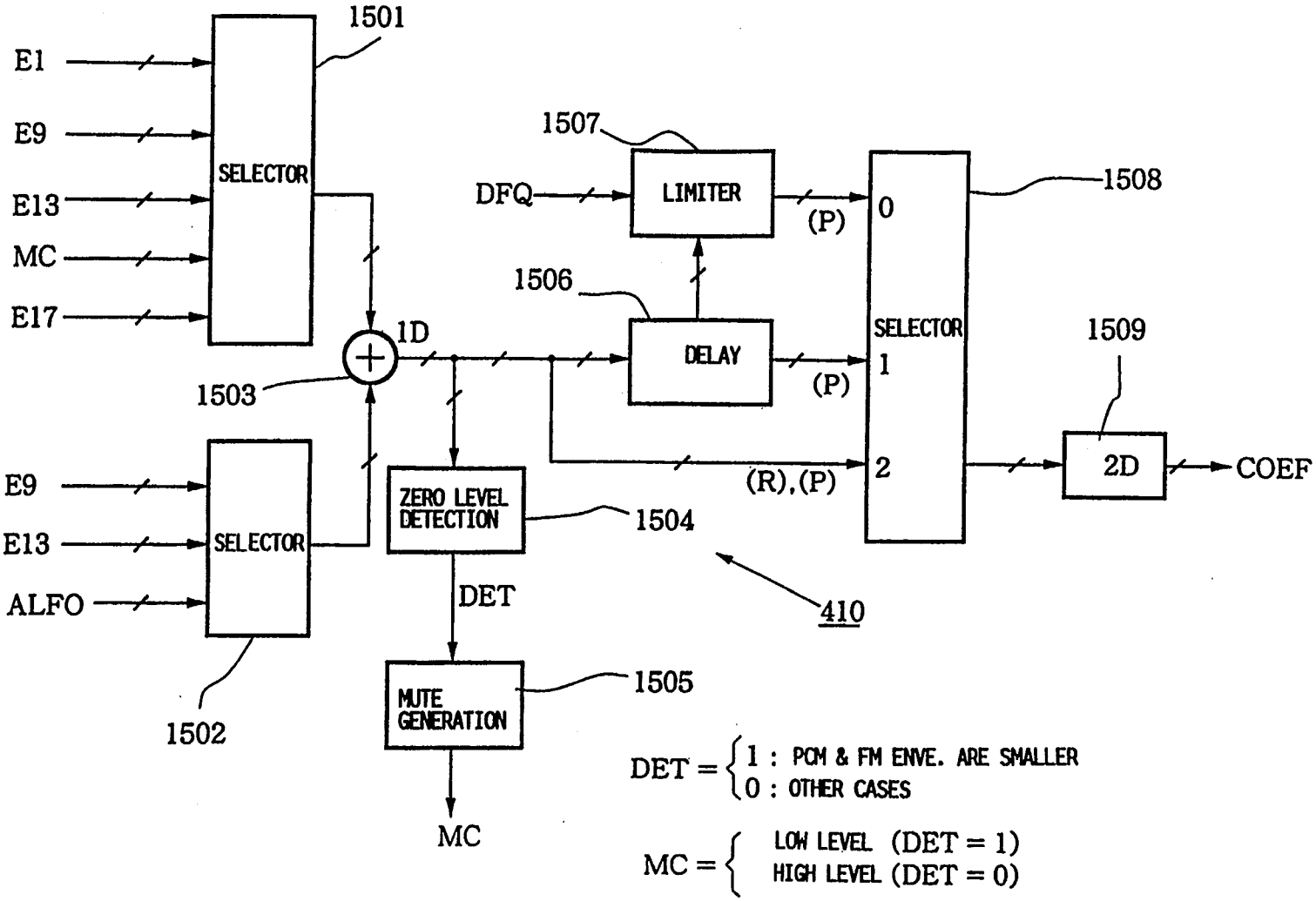
FIG. 15 is a block diagram showing a coefficient generation section in FIG. 4.

Referring now to FIG. 15, the coefficient generation section 410 of FIG. 4 will be described. The coefficient generation section 410 includes a selector 1501, a selector 1502, an adder 1503, a 0 level detection section 1504, a mute generation section 1505, a delay circuit 1506, a limiter 1507, a selector 1508 and a delay circuit 1509.

To the selector 1501 are applied data E1, E9, E13 and E17 derived from predetermined tap positions of the shift register 807 of the EG 405 of FIG. 8. The data E1 is data of the first stage of the shift register 807, the data E9 is data of the ninth stage of the shift register 807, the data E13 is data of the thirteenth stage of the shift-register 807 and the data E17 is data of the seventeenth stage of the shift register 807. The data E1 is data processed at the timing which is one clock before data which is currently being processed in the EG 405. The data E9, E13 and E17 are respectively data processed at the timings which are respectively 9 clocks, 13 clocks and 17 clocks before data which is currently being processed. A mute signal MC from the mute generation section 1505 is applied to the selector 1501.

To the selector 1502 are applied the data E9 and E13 of the shift register 807 of the EG 405. To the selector 1502 is applied an LFO output ALFO from the selector 409 of FIG. 4.

Outputs of the selectors 1501 and 1502 are applied to the adder 1503. The adder 1503 has delay time of one clock. Result of the addition is applied to the delay circuit 1506 and the level detection section 1504. The delay circuit 1506 delays the input signal by one clock and provides the delayed output to the limiter 1507 and the first input terminal of the selector 1508. The limiter 1507 receives data DFQ which determines Q of the digital filter of the operation section 404 and applies an amplitude limitation to the input from the delay circuit 1506.

The 0 level detection section 1504 detects whether the result of the addition by the adder 1503 is "0" level or not and, when it has detected the "0" level, it produces a detection signal DET. The detection signal DET is specifically a signal which is "1" when the PCM envelope and FM envelope are smaller than a predetermined value (when predetermined high order bits of the data are "0") and otherwise is "0". The detection signal DET is applied to the mute generation section 1505. The mute generation section 1505 produces, in response to the detection signal DET, the mute signal MC which is at a low level when the detection signal DET is "1" and is at a high level when the detection signal DET is "0".

The selector 1508 receives the output of the limiter 1507 at its 0-th input terminal, the output of the delay circuit 1506 at its first input terminal and the output of the adder 1503 at its second input terminal. The output of the selector 1508 is delivered out as a signal COEF through the delay circuit having delay time of 2 clocks.

The manner of determining data provided by the selectors 1501, 1502 and 1508 will be described more fully later.

Figure 16:
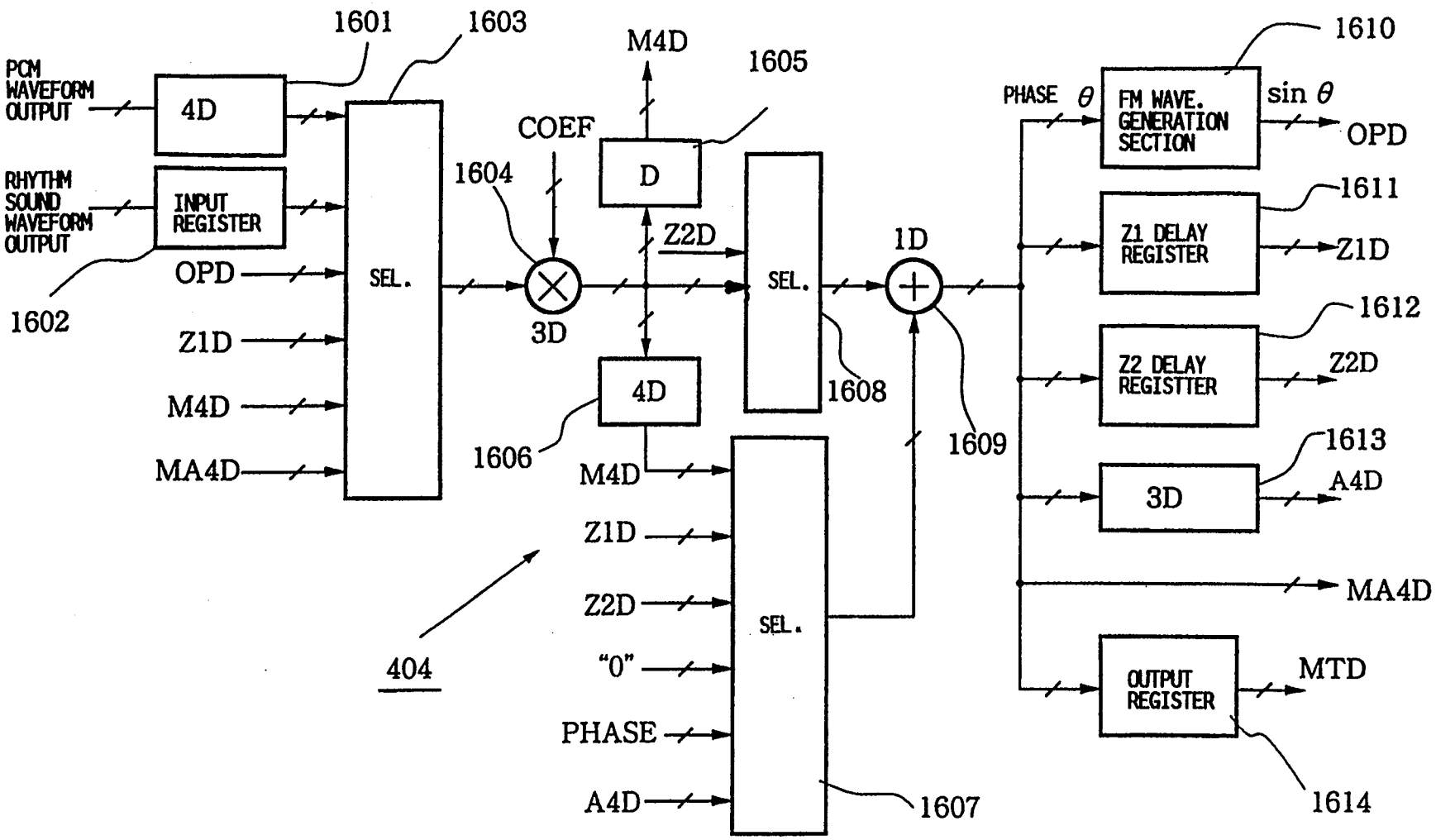
FIG. 16 is a block diagram showing an operation section in FIG. 4.

Referring now to FIG. 16, the operation section 404 of FIG. 4 will be described. The operation section 404 includes a delay circuit 1601, an input register 1602, a selector 1603, a multiplier 1604, a delay circuit 1605, a delay circuit 1606, a selector 1607, a selector 1608, an adder 1609, an FM waveform generation section 1610, Z1 delay register 1611, a Z2 delay register 1612, a delay circuit 1613 and an output register 1614.

The PCM waveform output 1WD provided by the interpolation section 403 is applied to the delay circuit 1601 and, after being delayed by 4 clocks, is applied to the selector 1603. Similarly, the rhythm sound waveform output 1WD provided by the interpolation section 403 is applied to the selector 1603 through the input register 1602. To the selector 1603 are applied an output signal OPD from the FM waveform generation section 1610, an output signal Z1D from the Z1 delay register 1611, an output signal M4D from the delay circuit 1605 and an output signal MA4D from the adder 1609.

A selection output of the selector 1603 is applied to the multiplier 1604 where it is multiplied with the coefficient output COEF from the coefficient generation section 410. The multiplier 1604 has delay time of 3 clocks. Result of the multiplication by the multiplier 1604 is delayed by one clock by the delay circuit 1605 and thereafter is applied as the output signal M4D to the selector 1603. The result of the multiplication by the multiplier 1604 is applied also to the selector 1608. To the selector 1608 is applied also the output signal Z2D from the Z2 delay register 1612. The selection output of the selector 1608 is applied to the adder 1609.

The result of the multiplication by the multiplier 1604 is delayed by 4 clocks by the delay circuit 1606 and thereafter is applied to the selector 1607. To the selector 1607 are applied the output signal Z1D from the Z1 delay register 1611, output signal Z2D from the Z2 delay register 1612, a signal "0" which is always a constant "0", a phase PHASE provided by the read section 402 of FIG. 5 and an output signal A4D from the delay circuit 1613. The selection output of the selector 1607 is applied to the adder 1609.

The adder 1609 adds the output signal from the selector 1607 and the output signal from the selector 1608 together. Result of the addition is applied to the FM waveform generation section 1610, Z1 delay register 1611, Z2 delay register 1612, delay circuit 1613 and output register 1614. The result of the addition by the adder 1609 is also delivered out directly as the output signal MA4D and applied to the selector 1603.

A final output signal of the operation section 404 is provided as the signal MTD from the output register 1614.

Referring now to the time chart of FIG. 17, the operation for tone waveform generation in the i-th channel will be described. Description will be made on the assumption that the i-th channel belongs to the A slot of FIG. 3.

Figure 17:
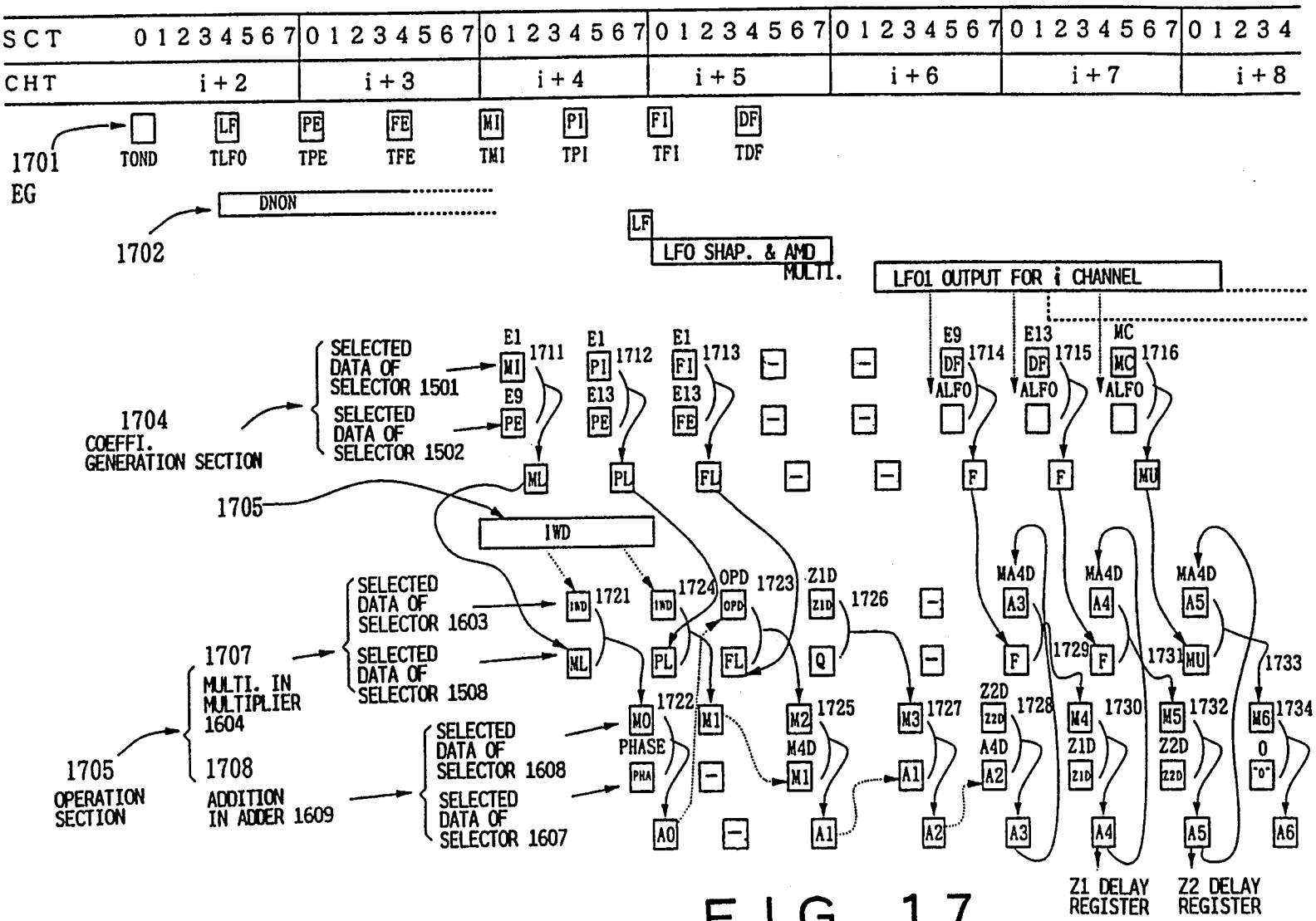
FIG. 17 is a time chart for explaining an operation for generating a tone waveform.

The eight square blocks designated by reference character 1701 in FIG. 17 represent timings of processings concerning the i-th channel performed in the EG 405. Reference characters TOND, TLFO, TPE, TFE, TMI, TPI, TFI and TDF designate timing signals which have already been described with reference to FIGS. 2, 3 and 8. The reference characters in the squares designate data which are processed by the EG 405 at timings at which the corresponding timing signals are generated (i.e., data which are normally accumulated by the adder 804).

More specifically, the data LF is LFO output data which is processed by the EG 405 at the timing at which the timing signal TLFO of CHT=i+2, SLT=4 is generated. The data PE is PCM envelope data which is processed by the EG 405 at the timing of the timing signal TPE of CHT=i+3, SLT=0. The data FE is FM envelope data which is processed by the EG 405 at the timing of the timing signal TFE of CHT=i+3, SLT=4. The data MI is interpolated modulation level data which is processed by the EG 405 at the timing of the timing signal TMI of CHT=i+4, SLT=4. The data PI is interpolated PCM level data which is processed by the EG 405 at the timing of the timing signal TPI of CHT=i+4. SLT=4. The data FI is FM level data which is processed by the EG 405 at the timing of the timing signal TFI of CHT=i+5, SLT=0. The data DF is interpolated DCF coefficient data which is processed by the EG 405 at the timing of the timing signal TDF of CHT=i+5, SLT=4.

Reference character 1702 designates a timing at which the delay note-on DNON is generated. The delay note-on DNON is generated at a timing (CHT=i+2, SLT=4) which is delayed by predetermined time from a timing at which the note-on delay function is performed (CHT=i+2, SLT=0).

Reference character 1703 designates a processing timing in the waveform rectification section 408 in FIG. 4. At a timing of CHT=i+4, SLT=7, the LFO latch 406 latches the LFO output from the EG 405 of FIG. 8. For this purpose, a tap for the LFO output is provided at the (16+3)-th stage of the shift register of the EG 405. The LFO output can be taken out by providing the tap at the "16+3" stage, i.e., the position at which processed data of 19 clocks before can be accessed, because the timing of CHT=i+2, SLT=4 which is 19 clocks before the timing of CHT=i+4, SLT=7 is the timing at which the LFO output processing is made.

At any slot of the A slot to D slot, loading of the LFO output LF is made at the timing of SLT=7 within a range of CHT+2 which is 2 clocks advanced from the channel time CHT in which the timing signal TLFO concerning the particular channel is included. Accordingly, in synchronism with this timing, at B slot, the LFO output is taken out by providing a tap at a "16+2" state, i.e., a position at which processed data of 18 clocks before in the shift register 807 can be accessed. At C slot, the LFO output is taken out by providing a tap at a "16+1" stage, i.e., a position at which processed data of 17 clocks before can be accessed. At D slot, the LFO output is taken out by providing a tap at a "16+0" stage, i.e., a position at which processed data of 16 clocks before can be accessed.

The waveform rectification section 408 of FIG. 4 performs, at the timing of CHT=i+5, SLT=0–7, a waveform rectification processing at a processing for multiplication of the amplitude modulation depth AMD in response to the LFO output LF provided. Results of these processings are provided at timings of CHT=i+6, SLT=2 to CHT=i+8, SLT=1 at a terminal LFO1 (output of the waveform rectification section 408 in FIG. 4) as the LFO output for the i-th channel. Similarly, at timings of CHT=i+7, SLT=2 to CHT=i+9, SLT=1, LFO outputs for the i+1 channel are provided at a terminal LFO2.

The outputs of the terminals LFO1 and LFO2 are applied to the selector 409 in which the selection output is switched at the least significant bit SLTO of the slot time SLT. The selector 409 selects and outputs LFO1 in the i-th channel of this example and LFO2 in the i+1-th channel and supplies it as the output data ALFO to the selector 1502 of the coefficient generation section 410 of FIG. 15.

Reference character 1704 of FIG. 17 designate processing timings in the coefficient generation section 410 of FIG. 15. No significant processing is executed at a timing which is designated by "-" (meaning "rest") in a square block designating each timing.

At a timing (CHT=i+4, SLT=1) which is a next timing after the EG 405 performs the interpolation operation with respect to the modulation level at the timing of CHT=i+4, SLT=0, the selector 1501 of the coefficient generation section 410 selects and outputs input data E1 and the selector 1502 selects and outputs input data E9. At this time, the data E1 is the interpolated modulation level data MI which is processed data of one clock before and the data E9 is the PCM envelope data PE which is processed data of 9 clocks before.

These data MI and PI are added together by the adder 1503 (reference character 1711). The modulation level data ML which is result of the addition is delayed by one clock by the adder 1503 and thereafter is supplied from the adder 1503 to the selector 1508 at the timing of CHT=i+4, SLT=2. At this time, the selector 1508 is controlled so that it will select and output a second terminal input and, therefore, this modulation level data ML is supplied from the selector 1508 to the delay circuit 1509. This modulation level data ML is delayed by 2 clocks by the delay circuit 1509 and thereafter is applied, at the timing of CHT=i+4, SLt=4, to the multiplier 1604 in the operation section 404 as a multiplier (i.e., coefficient COEF).

Then, at the timing of CHT=i+4, SLT=5, the selector 1501 of the coefficient generation section 410 selects and outputs the input data E1 and the selector 1502 selects and outputs the input data E13. At this time, the data E1 is the interpolated PCM level data PI which is processed data of one clock before and the data E13 is the PCM envelope data PE which is processed data of 13 clocks before.

These data PI and PE are added together by the adder 1503 (reference character 1712). The PCM level data PL which is result of the addition is delayed by the adder 1503 by one clock and thereafter is applied from the adder 1503 to the selector 1508 at the timing of CHT=i+4, SLT=6. At this time, the selector 1508 is controlled so that it will select and output a second terminal input and, therefore, the PCM level data PL is supplied from the selector 1508 to the delay circuit 1509. The PCM level data PL is delayed by 2 clocks by the delay circuit 1509 and, at the timing of CHT=i+5, SLT=0, is applied to the multiplier 1604 in the operation section 404 as a multiplier (i.e., coefficient COEF).

Then, at the timing of CHT=i+5, SLT=1, the selector 1501 of the coefficient generation section 410 selects and outputs the input data E1 and the selector 1502 selects and outputs the input data E13. At this time, the data E1 is the interpolated FM level data FI which is processed data of one clock before and the data E13 is the EM envelope data FE which is processed data of 13 clocks before.

These data FI and FE are added together by the adder 1503 (reference character 1713). The FM level data FL which is result of the addition is delayed by the adder 1503 by one clock and thereafter is applied from the adder 1503 to the selector 1508 at the timing of CHT=i+5, SLT=2. At this time, the selector 1508 is controlled so that it will select and output a second terminal input and, therefore, the FM level data FL is supplied from the selector 1508 to the delay circuit 1509. The FM level data FL is delayed by 2 clocks by the delay circuit 1509 and, at the timing of CHT=i+5, SLT=4, is applied to the multiplier 1604 in the operation 404 as a multiplier (i.e. coefficient COEF).

Then, at the timing of CHT=i+6, SLT=5, the selector 1501 of the coefficient generation section 410 selects and outputs the input data E9 and the selector 1502 selects and outputs the input data ALFO. At this time, the data E9 is the interpolated DCF coefficient data DF which is processed data of 9 clocks before and the data ALFO is the LFO output data from the LFO1 terminal of the waveform rectification section 408.

These data DF and ALFO are added together by the adder 1503 (reference character 1714). The filter coefficient F which is result of the addition is delayed by the adder 1503 by one clock and thereafter is applied from the adder 1503 to the selector 1508 at the timing of CHT=i+6, SLT=6. At this time, the selector 1508 is controlled so that it will select and output a second terminal input and, therefore, the filter coefficient F is supplied from the selector 1508 to the delay circuit 1509. The filter coefficient is delayed by 2 clocks by the delay circuit 1509 and, at the timing of CHT=i+7, SLT=0, is applied to the multiplier 1604 in the operation section 404 as a multiplier (i.e., coefficient COEF).

Similarly, at the timing of CHT=i+7, SLT=1, the selector 1501 of the coefficient generation section 410 selects and outputs the input data E13 and the selector 1502 selects and outputs the input data ALFO. At this time, the data E13 is the interpolated DCF coefficient data DF which is processed data of 13 clocks before and the data ALFO is the LFO output data from the FLO1 terminal of the waveform rectification section 408. These data DF and ALFO are processed in the same manner as described before (reference character 1715) and, as a result, the filter coefficient F is applied to the multiplier 1604 of the operation section 404 as a multiplier (i.e., coefficient COEF) at the timing of CHT=1+7. SLT=4.

At the timing of CHT=i+7, SLT=5, the selector 1501 selects and outputs the mute signal MC and the selector 1502 selects and outputs the input data ALFO. These data MC and ALFO are added together by the adder 1503 (reference character 1716). The mute level MU which is result of the addition is delayed by the adder 1553 by one clock and thereafter is applied from the adder 1503 to the selector 1508 at the timing of CHT=i+7, SLT=6. At this time, the selector 1508 is controlled so that it will select and output a second terminal input and, therefore, the mute level MU is supplied from the selector 1508 to the delay circuit 1509. The PCM level data PL is delayed by 2 clocks by the delay circuit 1509 and, at the timing of CHT=i+8, SLT=0, is applied to the multiplier 1604 in the operation section 404 as a multiplier (i.e., coefficient COEF).

In the foregoing manner, the coefficient generation section 410 generates the coefficient COEF at the respective timings. The above description has been made with respect to the i-th channel of the A slot. In the other slots and channels, the same processing is made except for the channel time CHT and the slot time SLT.

In FIG. 17, reference character 1705 designates an interpolated (at four points) PCM waveform data IWD provided by the interpolation section 403 of FIG. 7. As described before, the interpolated PCM waveform data IWD for the i-th channel is produced at the channel time CHT=i+4.

Reference character 1706 designates a processing timing in the operation section 404 in FIG. 16. Particularly, reference character 1707 designates a multiplication operation in the multiplier 1604 in the operation section 404 and reference character 1708 designates an addition operation in the adder 1609.

The selector 1603 in the operation section 404 selects and outputs the PCM waveform data IWD from the delay circuit 1601 to the multiplier 1604 at the timing of CHT=i+4, SLT=4. To the multiplier 1604 is applied the modulation level data ML as the multiplier COEF.

The multiplier 1604 multiplies these data IWD and ML with each other and produces a result of the multiplication, i.e., waveform data M0 incorporating the amplitude modulation (reference character 1721). The multiplier 1604 has delay time of 3 clocks so that the waveform data M0 is supplied to the selector 1608 at the timing of CHT=i+4, SLT=7.

At this time, the selector 1608 is controlled so that it will select and output data from the multiplier 1604. On the other hand, the selector 1607 selects and outputs the input phase PHASE at the timing of CHT=i+4, SLT=7. The adder 1609, therefore, adds the waveform data M0 and the phase data PHASE together (reference character 1722) and, after delay of one clock, supplies result of the addition as FM phase data A0 to the FM waveform generation section 1610 or other parts. The FM waveform generation section 1610 generates, in response to this input data A0, FM waveform data OPD (operator data) at the timing of CHT=i+5, SLT=4.

At the timing of CHT=i+5, SLT=4, as described previously, the FM level data FL is applied as the multiplier COEF to the multiplier 1604. The multiplier 1604 multiplies these data OPD and FL with each other (reference character 1723) and produces a result of the multiplication, i.e., FM waveform data M2 which reflects the FM level data. The multiplier 1604 has delay time of 3 clocks and, therefore, the FM waveform data M2 is supplied to the selector 1608 at the timing of CHT=i+5, SLT=7. At this time, the selector 1708 is controlled so that it will select and output data from the multiplier 1604 and, therefore, the FM waveform data M2 is applied to the adder 1609.

On the other hand, the selector 1603 of the operation section 404 selects and outputs the PCM waveform data IWD from the delay circuit 1601 to the multiplier 1604 at the timing of CHT=i+5, SLT=0. At this time, as described above, the PCM level data PL is applied as the multiplier COEF to the multiplier 1604. The multiplier 1604 multiplies these data IWD and PL with each other and provides a result of the multiplication, i.e., PCM waveform data M1 in which the PCM level data is reflected (reference character 1724).

The multiplier 1604 has delay time of 3 clocks and, therefore, the PCM waveform data M1 is supplied to the delay circuit 1606 at the timing of CHT=i+5, SLT=3. The delay circuit 1606 has delay time of 4 clocks and, therefore, the PCM waveform data M1 is applied to the selector 1607 at the timing of CHT=i+5, SLT=7. At this time, the selector 1607 selects and outputs the PCM waveform data M1.

Therefore, at the timing of CHT=i+5, SLT=7, the PCM waveform data M1 and the FM waveform data M2 are applied to the adder 1609 and added together (reference character 1725). Result of the addition is delayed by the delay time (one clock) of the adder 1609 and thereafter is provided as waveform data A1 which is a sum of the waveform data PCM and FM at the timing of CHT=i+6, SLT=0. This waveform data A1 is applied to the delay circuit 1613 having delay time of 3 clocks.

In the above described manner, basic waveform data A1 which is a sum of PCM and FM is generated. Then, this waveform data is processed through the digital filter. A processing corresponding to this digital filter will be described below.

The selector 1603 selects and outputs the input data Z1D to the multiplier 1604 at the timing of CHT=i+6, SLT=0. The input data Z1D is data which was stored already in the Z1 delay register 1611 of FIG. 16 at the timing of CHT=i+7, SLT=4 when the processing of the i-th channel was performed. At this time, the selector 1508 of the coefficient generation section 410 of FIG. 15 selects and outputs Q of the digital filter which is data provided by the limiter 1507 and this data Q is applied as the multiplier COEF to the multiplier 1604.

The multiplier 1604 multiplies these data Z1D and Q with each other and provides data M3 which is result of the multiplication. The multiplier 1604 has delay time of 3 clocks and, therefore, the data M3 is supplied to the selector 1608 at the timing of CHT=i+6, SLT=3.

At this time, the selector 1608 is controlled so that it will select and output data from the multiplier 1604 and, therefore, the data M3 is applied to the adder 1609. The selector 1607 is controlled so that it will select and output input data A4D. This input data A4D is the waveform data A1 which is a sum of the above described PCM and FM waveforms which is provided through the delay circuit 1613.

Accordingly, at the timing of CHT=i+6, SLT=3, the adder 1609 adds the waveform data A1 and the data M3 together (reference character 1727). Result of the addition is delayed by the delay time of the adder 1609 (one clock) and thereafter is provided as the waveform data A2 at the timing of CHT=i+6, SLT=7. This waveform data A2 is applied to the delay circuit 1613 having delay time of 3 clocks and applied to the selector 1607 as input data A4D at the timing of CHT=i+6, SLT=7.

At this timing of CHT=i+6, SLT=7, the selector 1608 selects and outputs the input data Z2D. The input data Z2D is the data which was stored in the Z2 delay register 1612 of FIG. 16 at the timing of CHT=i+8, SLT=0 during the preceding processing of the i-th channel.

Accordingly, at the timing of CHT=i+6, SLT=7, the adder 1609 adds the waveform data A2 and the data Z2D together (reference character 1728). Result of the addition is delayed by the delay time (one clock) of the adder 1609 and thereafter is provided as the waveform data A3 at the timing of CHT=i+7, SLT=0. This waveform data A3 is applied directly as input data MA4D to the selector 1603. At this time, the selector 1603 is controlled so that it will select and output the input data MA4D and, therefore, the waveform data A3 is applied to the multiplier 1604.

As described previously, at the timing of CHT=i+7, SLT=0, the filter coefficient F is applied as the multiplier COEF to the multiplier 1604. The multiplier 1604 multiplies these data A3 and F with each other and provides waveform data M4 as result of the multiplication (reference character 1729). Since the multiplier 1604 has delay time of 3 clocks, the waveform data M4 is supplied to the selector 1608 at the timing of CHT=i+7, SLT=3. At this time, the selector 1608 is controlled so that it will select and output data from the multiplier 1604 and, therefore, the waveform data M4 is applied to the adder 1609.

At this time, the selector 1607 selects and outputs the input data Z1D from the Z1D delay register 1611. Accordingly, at the timing of CHT=i+7, SLT=3, the adder 1609 adds the waveform data M4 and the data Z1D together (reference character 1730). Result of the addition is delayed by the delay time of the adder 1609 (one clock) and thereafter is provided as waveform data A4 at the timing of CHT=i+7, SLT=4. This waveform data A4 is stored in the Z1 delay register 1611 and also is applied directly as input data MA4D to the selector 1603. At this time, the selector 1603 is controlled so that it will select and output this input data MA4D. The waveform data A4, therefore, is applied to the multiplier 1604.

As described previously, at the timing of CHT=i+7, SLT=4, the filter coefficient F is applied as the multiplier COEF to the multiplier 1604. The multiplier 1604 multiplies these data A4 and F with each other and provides waveform data M5 as result of the multiplication (reference character 1731). Since the multiplier 1604 has delay time of 3 clocks, the waveform data M5 is supplied to the selector 1608 at the timing of CHT=i+7, SLT=7. At this time, the selector 1608 is controlled so that it will select and output data from the multiplier 1604 and, therefore, the waveform data M5 is applied to the adder 1609.

At this time, the selector 1607 selects and outputs the input data Z2D from the Z2D delay register 1612. Accordingly, at the timing of CHT=i+7, SLT=7, the adder 1609 adds the waveform data M5 and the data Z2D together (reference character 1732). Result of the addition is delayed by the delay time of the adder 1609 (one clock) and thereafter is provided as waveform data A5 at the timing of CHT=i+8, SLT=0. This waveform data A5 is stored in the Z2 delay register 1612 and also is applied directly as input data MA4D to the selector 1603. At this time, the selector 1603 is controlled so that it will select and output this input data MA4D. The waveform data AS, therefore, is applied to the multiplier 1604.

As described previously, at the timing of CHT=i+8, SLT=0, the mute level MU is applied as the multiplier COEF to the multiplier 1604. The multiplier 1604 multiplies these data A5 and MU with each other and provides waveform data M6 as result of the multiplication (reference character 1733). Since the multiplier 1604 has delay time of 3 clocks, the waveform data M6 is supplied to the selector 1608 at the timing of CHT=i+8, SLT=3. At this time, the selector 1608 is controlled so that it will select and output data from the multiplier 1604 and, therefore, the waveform data M6 is applied to the adder 1609.

At this time, the selector 1607 selects and outputs the input data "0". Accordingly, at the timing of CHT=i+8, SLT=3, the adder 1609 adds the waveform data M6 and the data "0" together (reference character 1734). Result of the addition is delayed by the delay time of the adder 1609 (one clock) and thereafter is provided as waveform data A6 at the timing of CHT=i+8, SLT=4. This waveform data A6 is stored in the output register 1614 of FIG. 16 and is supplied as the final waveform data of the i-th channel to a channel accumulator of next stage.

Referring now to the time chart of FIG. 18, the operation in the thirtieth and thirty-first channels in the rhythm mode, i.e., the rhythm sound waveform generation for 8 channels, will be described.

Figure 18:
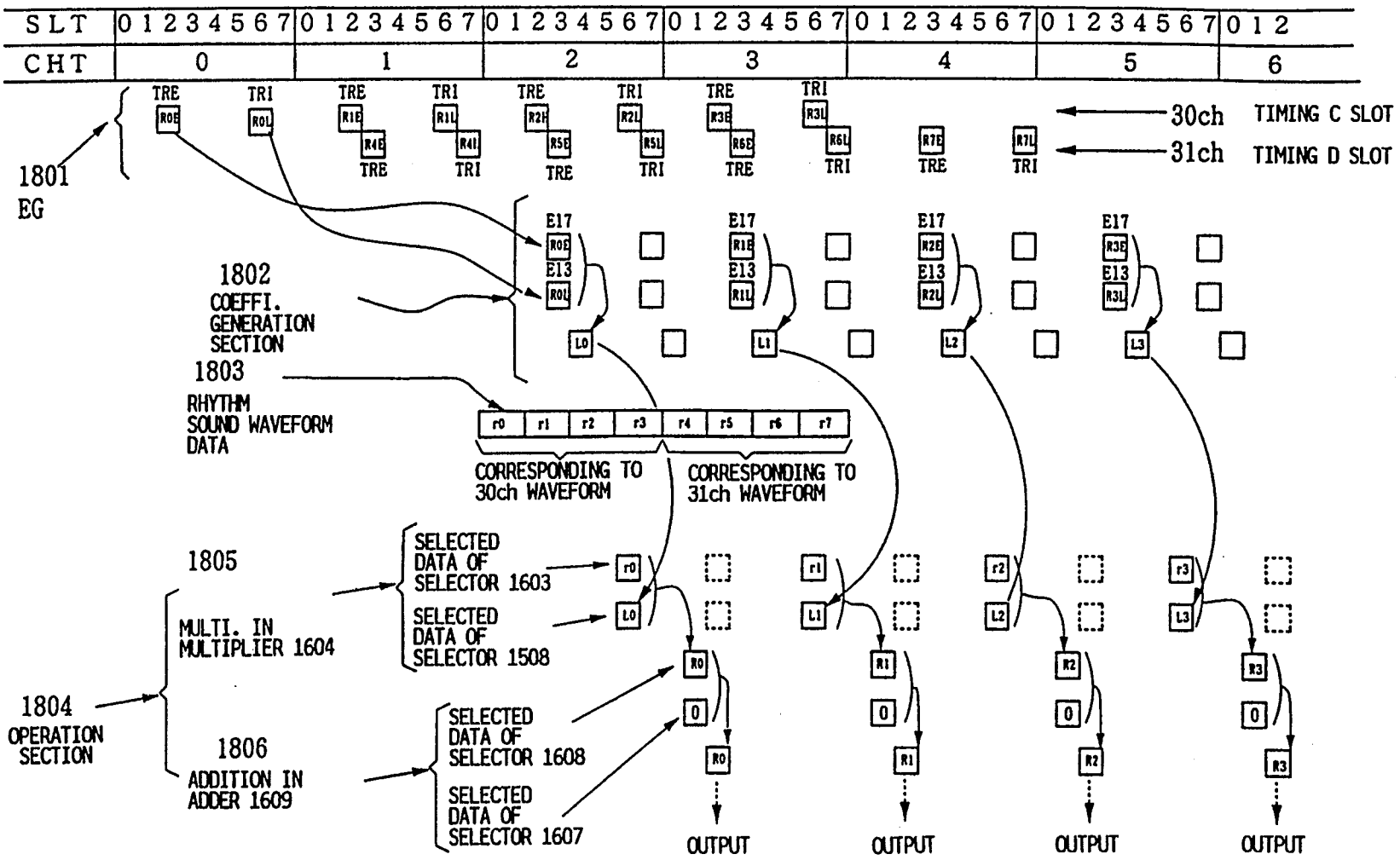
FIG. 18 is a time chart for explaining an operation for generating a rhythm sound waveform.

In FIG. 18, sixteen square blocks designated by reference character 1801 indicate processing timings of the EG 405 in the thirtieth channel belonging to the C slot and the thirty-first channel belonging to the D slot. In the rhythm mode, the EG 405 performs processings for generating a rhythm sound waveform at these timings. Reference characters TRE and TRI appearing above or below these squares indicate the timing signals which have been described with reference to FIGS. 2, 3 and 8. Reference characters appearing in these squares indicate data which are processed by the EG 405 at timings at which the corresponding timing signals are generated (normally data which are accumulated by the adder 804).

More specifically, RnE (where n is 0 to 7) designates envelope data of a rhythm sound which is processed by the EG 405 at the timing at which the timing signal TRE corresponding to the n-th channel of the rhythm sound is generated. RnI (where n is 0 to 7) designates level data of a rhythm sound which is processed by the EG 405 at the timing at which the timing signal TRE corresponding to the n-th channel of the rhythm sound is generated.

Reference character 1802 designates processing timings in the coefficient generation section 410 of FIG. 15. A selector 1501 of the coefficient generation section 410 selects and outputs input data E17 at the timing of CHT=2, SLT=3. A selector 1502 selects and outputs input data E13. At this time, the data E17 is envelope data ROE of the rhythm sound 0-th channel which is data processed 17 clocks before and the data E13 is level data R0L of the rhythm sound 0-th channel which is data processed 13 clocks before.

These data R0E and R0L are added together by an adder 1503 (reference character 1811). Data L0 which is a result of the addition is delayed by one clock by the adder 1503 and supplied from the adder 1503 to a selector 1508 at the timing of CHT=2, SLT=4. At this time, the selector 1508 is controlled so that it will select and output an input at its second terminal and, therefore, the data L0 is supplied from the selector 1508 to a delay circuit 1509. This data L0 is delayed by 2 clocks by the delay circuit 1509 and applied as a multiplier (i.e., coefficient COEF) to a multiplier 1604 of the operation section 404 at the timing of CHT=2, SLT=6.

Reference character 1803 designates rhythm sound waveform data IWD provided by the interpolation section 403 of FIG. 16. As described previously, the waveform data r0 to r3 of the rhythm sound 0-th to third channels are produced within a range of CHT=2 and the waveform data r4 to r7 of the rhythm sound fourth to seventh channels are produced within a range of CHT=3.

Reference character 1804 designates processing timings in the operation section 404 of FIG. 16. Particularly, reference character 1805 designates multiplication in a multiplier 1604 of the operation section 404 and reference character 1806 designates addition in an adder 1609.

A selector 1603 of the operation section 404 selects and outputs the waveform data r0 of the rhythm sound 0-th channel from an input register 1602 to the multiplier 1904 at the timing of CHT=2, SLT=6 in the rhythm mode. At this time, as described previously, the data L0 is applied as the multiplier COEF to the multiplier 1604. The multiplier 1604 multiplies these data r0 and L0 with each other and waveform data R0 of the rhythm sound 0-th channel as a result of the multiplication (reference character 1812). Since the multiplier 1604 has delay time of 3 clocks, the rhythm sound waveform data R0 is produced at the timing of CHT=3, SLT=1.

At this time, a selector 1608 is controlled so that it will select and output data from the multiplier 1604. On the other hand, a selector 1607 selects and outputs input data "0" at the timing of CHT=3, SLT=1. At this time, therefore, the adder 1609 adds the rhythm sound waveform data R0 and the data "0" together (reference character 1813) and, after delay time of one clock, provides result of the addition as waveform data R0 at the timing of CHT=3, SLT=2. This waveform data R0 is stored in an output register 1614 of FIG. 16 and supplied to an accumulator of next stage as waveform data of a final rhythm sound 0-th channel.

The above described processing is one for the rhythm sound 0-th channel. Similar processings are made at predetermined timings with respect to the other rhythm sound first to seventh channels and waveforms shown in FIG. 18 are produced.

Figure 19:
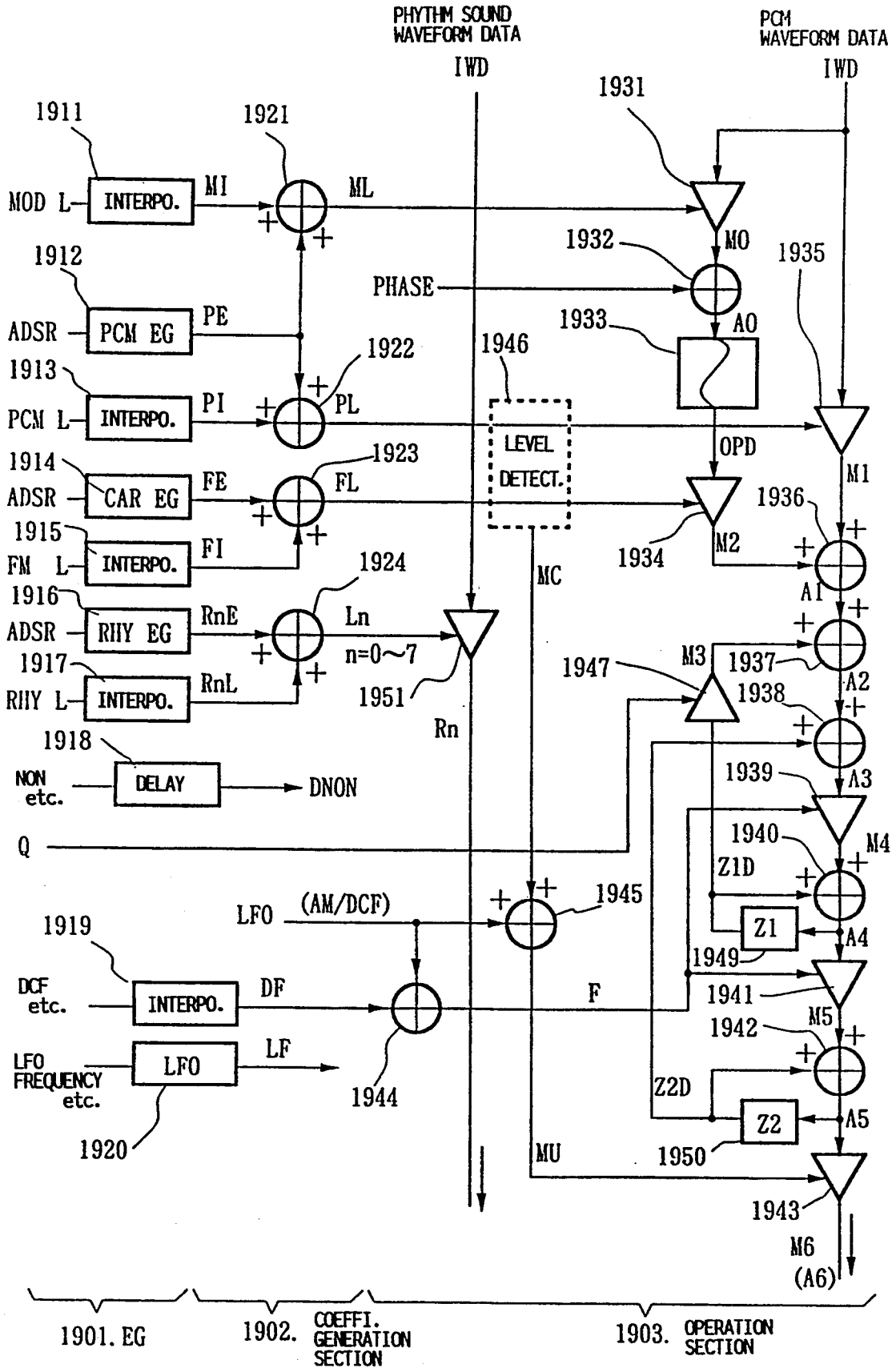
FIG. 19 is a schematic diagram showing a basic signal processing in a waveform generation processing.

FIG. 19 schematically illustrates the basic signal processing in the waveform generation processing described with reference to FIGS. 17 and 18. The portion designated by reference character 1901 shows the function of the EG 405.

An interpolation operation 1911 is a processing in which a parameter MODL for the modulation factor level is applied to perform an interpolation operation and an interpolated modulation factor level MI is provided. This is an interpolation operation performed by the EG 405 at the timing of FM modulation factor level interpolation timing signal TMI. The input parameter MODL corresponds to the FM modulation factor interpolation rate 905 of the rate register section 116 and the FM modulation level data 1007 of the target register section 117.

A PCM EG processing 1912 is a processing in which PCM envelope data PE is provided by applying ADSR data. This is a processing performed by the EG 405 at the timing of the PCM EG timing signal TPE. The input parameter ADSR consists of rates and levels of the attack portion, first decay portion, second decay portion and release portion and corresponds to data stored in the PCM EG rate register 903 of the rate register section 116 and the PCM EG target register 1005 of the target register section 117.

A PCM level interpolation processing 1913 is a processing in which an interpolation processing is performed by applying a parameter PCML for the PCM level data and an interpolated level PI is produced. This is a processing performed by the EG 405 at the timing of the PCM level interpolation timing signal TPI. The input parameter PCML corresponds to the PCM level interpolation rate 906 and the PCM level data 1008.

An FM EG processing 1914 is a processing in which FM envelope data FE is generated by applying ADSR data. This is a processing performed by the EG 405 at the tinning of the FM EG timing signal TFE. The input parameter ADSR corresponds to data stored in the FM EG rate register 904 and the FM EG target register 2006.

An FM level interpolation processing 1915 is a processing in which an interpolation operation is performed by applying a parameter FML for the FM level data and an interpolated level FI is produced. This is a processing performed by the EG 405 at the timing of the FM level interpolation timing signal TFI. The input parameter FML corresponds to the FM level interpolation rate 907 and the FM level data 1009.

A rhythm sound EG processing 1916 is a processing in which rhythm sound envelope data RnE (where n is 0 to 7) is produced by applying ADSR data. This is a processing performed by the EG 405 at the timing of the rhythm EG timing signal TRE. The input parameter ADSR corresponds to data provided by the rhythm sound EG rate generation section 910 and the rhythm sound EG target value generation section 1011.

A rhythm sound level interpolation processing 1917 is a processing in which an interpolation processing is performed by applying a parameter RHYL for the rhythm sound level data and produces an interpolated level RnL (where n is 0 to 7). This is a processing performed by the EG 405 at the timing of the rhythm sound level interpolation timing signal TRI. The input parameter RHYL corresponds to the rhythm sound level interpolation rate 912 and the rhythm sound level data 1013.

A delay processing 1918 is a processing in which a delay note-on DNON is produced after delay of a predetermined delay time by applying a note-on NON. This is a processing performed by the EG 405 at the timing of the key-on delay timing signal TOND. A filter coefficient interpolation processing 1919 is a processing in which a filter coefficient DF is produced by performing interpolation of a filter coefficient of the digital filter of the operation section. This is a processing performed by the EG 405 at the timing of filter coefficient processing timing signal TDF. An LFO processing 1920 is a processing in which an LFO output is produced. This is a processing performed by the EG 405 at the timing of the LFO timing signal TFL.

In FIG. 19, the portion designated by reference character 1902 indicates a processing performed by the coefficient generation section 410. In the coefficient generation section 410, the modulation level MI interpolated by an addition section 1921 and the PCM envelope data PE are added together and a modulation level ML is thereby produced. In an addition section 1922, the PCM envelope data PE and th interpolated PCM level PI are added together and PCM level data PL is thereby is produced. Further, in an addition section 1923, the FM envelope data FE and the interpolated FM level FI are added together and FM level data FL is thereby produced. The processings in these addition sections 1921, 1922 and 1923 correspond to the processing in the adder 1503 of the coefficient generation section 410 of FIG. 15 and corresponds to the processing of reference character 1811 in FIG. 18.

In the rhythm mode, the rhythm sound envelope data RnE and the interpolated level RnL are added together in an addition section 1924 and rhythm sound level data RL is thereby produced. This corresponds to the processing of the adder 1503 of the coefficient generation section 410 in FIG. 15 and corresponds to the processing of reference character 1811 in FIG. 18.

In FIG. 19, a portion designated by reference character 1903 indicates a processing in the operation section 404. In the operation section 404, a multiplier section 1931 multiplies the PCM waveform data IWD from the interpolation section 403 with the modulation level ML and thereby produces amplitude modulated waveform data MO. An addition section 1932 adds the amplitude modulated waveform data M0 and the phase date PHASE together and produces an address A0 for FM waveform data 1933. The processings in the multiplier section 1931 and the addition section 1933 correspond to the processings of reference characters 1721 and 1722 of FIG. 17.

An FM waveform data section 1933 is accessed by this address A0 to provide FM waveform data OPD (i.e., operator data). This processing corresponds to the FM waveform generation processing in the FM waveform generation section 1610 of the operation section 404.

A multiplier section 1934 multiplies the FM waveform data OPD with the FM level FL and thereby produces FM waveform data M2. This is the processing of the multiplier 1604 of the operation section 404 and corresponds to the processing of reference character 1723 of FIG. 17.

A multiplier section 1935 multiplies the PCM waveform data IWD with the PCM level PL and thereby produces PCM waveform data Mi. This corresponds to the processing of reference character 1724 of FIG. 17. An addition section 1936 adds the PCM waveform data M1 and the FM waveform data M2 together and thereby produces waveform data A1 which is a sum of PCM and MF waveform data. This is the processing of the adder 1609 of the operation section 404 and corresponds to the processing of reference character 1725 of FIG. 17.

By the above described processings, basic waveform data has been generated. Subsequently, the operation section performs a processing in which this waveform data is processed through the digital filter. In the following description, a processing corresponding to FIG. 17 or FIG. 18 is designated by a corresponding reference character in a parenthesis.

A Z1 delay section 1949 corresponds to the Z1 delay register 1611 of the operation section multiplier section 1947 multiplies the output data Z1D from the Z1 delay section 1949 with the value of Q of the digital filter and thereby produces data M3 (1726). An addition section 1937 adds the waveform data A1 and the data M3 together (1727) and thereby produces waveform data A2. A Z2 delay section 1950 corresponds to the Z2 delay register 1612 of the operation section. An addition section 1938 adds the waveform data A2 and the output data Z2D from the Z2 delay register 1612 (1728) and thereby produces waveform data A3.

On the other hand, an addition section 1944 adds the DCF coefficient data DF and the LFO output together and thereby produces a filter coefficient F (1714, 1715). A multiplier section 1939 multiplies the waveform data A3 with the filter coefficient F (1729) and thereby produces waveform data A4. An addition section 1940 adds the waveform data M4 and the output data Z1D from the Z1 delay section 1949 together (1730) and thereby produces waveform data A4. This waveform data A4 is stored in a Z1 delay section 1949. A multiplier section 1941 multiplies the waveform data A4 with the filter coefficient F (1731) and thereby produces waveform data MS. An addition section 1942 adds the waveform data M5 and the output data Z2D from a Z2 delay section 1950 (1732) and thereby produces waveform data A5. This waveform data A5 is stored in the Z2 delay section 1950.

A level detection section 1946 detects the PCM level data PL and the FM level data FL and produces a mute signal MC which is a result of the detection. The level detection section 1946 corresponds to the 0 level detection section 1504 of FIG. 15. An addition section 1945 adds the mute signal MC and the LFO output data together (1716) and thereby produces a mute level MU. A multiplier section 1943 multiplies the waveform data A5 with the mute level MU (1733) and thereby produces waveform data M6 (output waveform data A6).

On the other hand, in the rhythm mode, a multiplier section 1951 multiplies the rhythm sound waveform data IWD with the rhythm sound level data RL (1812) and thereby produces a final rhythm sound waveform data Rn (where n is 0 to 7).

According to the above described embodiment, rhythm sound waveforms for 8 channels can be generated by using time slots for 2 channels (thirtieth and thirty-first channels) for normal tone waveform generation. Accordingly, the number of lines of waveforms generated can be increased without increasing the number of channels. Further, in the above described embodiment, slots for performing processing of respective channels are not continuous but dispersed so that the number of delay circuits used for synchronizing timings of the processing can be held at the minimum.

As described in the foregoing, according to the invention, when a first mode (e.g., the normal mode in the above described embodiment) is designated, amplitude values of plural sample points for one output are read out and one waveform data is provided on the basis of these amplitude values whereas, when a second mode (e.g., the rhythm mode in the above described embodiment) is designated, an amplitude value at one sample point is read out and this amplitude value is provided as waveform data. Accordingly, plural lines of waveform data can be generated without increasing the number of channels. Field of application of the waveform generation device therefore can be expanded.

We claim:

1. A waveform generation device comprising:

waveform memory means for storing waveform sample value data;

mode designation means for designating a first mode or a second mode; and processing means for controlling reading of the waveform memory means depending upon which of the first mode and the second mode is designated wherein:

when the first mode has been designated, for performing a processing for producing one sample value datum of a waveform on the basis of plural sample value data read from the waveform memory means, and when the second mode has been designated, for performing a processing for producing and outputting one waveform sample value datum on the basis of one sample value datum read from the waveform memory means.

2. A waveform generation device as defined in claim 1 wherein said mode designation means designates the first mode and the second mode on a time shared basis, and said processing means performs the processing of the first mode and the processing of the second mode on a time shared basis in accordance with time shared designation of the first mode and the second mode.

3. A waveform generation device as defined in claim 1 wherein said mode designation means is capable of selecting continuous designation of one of the first mode and the second mode or time shared designation of the first mode and the second mode, and said processing means performs the processing of the first mode and the processing of the second mode on a time shared basis when the time shared designation of the first mode and the second mode has been selected.

4. A waveform generation device as defined in claim 1 wherein said processing means reads out waveform sample value data from the waveform memory means in accordance with reading processing time slots of a predetermined period and, when the first mode has been designated, reads out a predetermined number of sample data values at a predetermined number of the time slots and produces and outputs one waveform sample value datum for one waveform and, when the second mode has been designated, reads out one sample value datum each for a predetermined number of different waveforms at the predetermined number of time slots and produces, on a time shared basis, sample value data for the different waveforms on the basis of these data.

5. A waveform generation device as defined in claim 4 wherein said processing means performs a waveform forming processing on a time shared basis individually for each of plural processing channels and a predetermined number of the time slots which are not adjacent to each other are allotted dispersely for one processing channel.

6. A waveform generation device as defined in claim 1 wherein said processing means, when said first mode has been designated, performs a predetermined interpolation operation using a plurality of the sample data read out from said waveform memory means, so as to output one sample value datum.

7. A waveform generation device as defined in claim 1 wherein said waveform memory means stores sample value data for waveforms of different types, and said processing means performs a waveform forming processing individually in each of plural processing channels and, when the first mode has been designated, reads out plural sample value data for one waveform from the waveform memory means by using one processing channel on a time shared basis and performs an operation for producing one waveform sample value datum on the basis of the read out plural sample value data and, when the second mode has been designated, reads out one sample value datum for plural different waveforms from the waveform memory means by using one processing channel on a time shared basis and produces, on a time shared basis, sample value data for the different waveforms on the basis of the read out data.

8. A waveform generation device as defined in claim 7 which further comprises envelope generation means for generating an envelope shape signal for controlling a tone signal and control means for controlling a tone waveform signal generated by the processing means by means of the envelope shape signal generated by the envelope generation means, said envelope generation means generating, when the first mode has been designated, one envelope shape signal in correspondence to said one processing channel and generating, when the second mode has been generated, plural envelope shape signals on a time shared basis in correspondence to said one processing channel.

9. A waveform generation device as defined in claim 1 which further comprises digital filter means for filtering waveform sample value data produced by the processing means in correspondence to the first mode.

10. A waveform generation device as defined in claim 1 which further comprises modulation operation means for performing a modulation operation with respect to waveform sample value data produced by the processing means in correspondence to the first mode.

11. A waveform generation device as defined in claim 10 wherein said modulation operation means amplitude modulates the waveform sample value data produced by the processing means with a predetermined modulating signal.

12. A waveform generation device as defined in claim 1 which further comprises means for generating phase data which changes in correspondence to a desired frequency and operation means for modulating the phase data by using, as a modulation signal, the waveform sample value data produced by the processing means in correspondence to the first mode.

13. A waveform generation device as defined in claim 1 wherein:

said processing means includes a means for sequentially reading sample value data from the waveform memory means; and when the first mode has been designated, the plural sample value data used in the processing for producing the one sample value datum of a waveform is sequentially read from the waveform memory means using the means for sequentially reading.

14. A waveform generation device as defined in claim 1 wherein:

said processing means includes a combination processing means for combining plural sample value data to form one sample value datum; and when the first mode has been designated, the processing for producing one sample value datum of a waveform on the basis of plural sample value data includes a combination processing performed by the combination processing means.

15. An electronic musical instrument comprising:

tone designation means for designating a tone to be generated;

waveform memory means for storing waveform sample value data;

mode designation means for designating a first mode or a second mode; and processing means for controlling reading of the waveform memory means depending upon which of the first mode and the second mode is designated and, when the first mode has been designated, performing a processing for producing and outputting one waveform sample value datum on the basis of plural sample value data read from the waveform memory means and, when the second mode has been designated, performing a processing for producing and outputting one waveform sample value datum on the basis of one sample value datum read from the waveform memory means.

16. An electronic musical instrument as defined in claim 15 wherein said tone designation means comprises means for designating a scale note and means for designating a rhythm, and said processing means controls, when the first mode has been designated, reading of the waveform memory means in accordance with a scale note designated by the tone designation means and controls, when the second mode has been designated, reading of the waveform memory means in accordance with a rhythm designated by the tone designation means.

17. A tone waveform generation device comprising:

function generation means for generating plural kinds of functions necessary for generation of a single tone by a time division multiplexing operation; wherein:

the function generation means comprises a plurality of circuits; and the plural kinds of functions are generated by the time division multiplexing operation using common circuits; and waveform generation means for forming at least one tone waveform signal controlled by the plural kinds of functions supplied by said function generation means, each of the plural kinds of functions achieving a characteristic of the tone waveform signal which is different from that achieved by each other of the plural kinds of functions.

18. A tone waveform generation device as defined in claim 17 herein said function generation means comprises an envelope generator having an adder and a delay circuit, said plural kinds of functions being generated by a time division multiplexing operation of said envelope generator.

19. A tone signal generation device as defined in claim 17 wherein a note-on signal designating generation of a tone is supplied to said function generation means and the plural kinds of functions generated by said function generation means include a function of a delay note-on signal obtained by delaying the note-on signal.

20. A tone waveform generation device as defined in claim 17 wherein the plural kinds of functions generated by said function generation means include a function of a modulating waveform signal for modulating a tone.

21. A tone waveform generation device as defined in claim 17 wherein the plural kinds of functions generated by said function generation means include an amplitude control function for controlling an amplitude of a tone to be generated.

22. A tone waveform generation device as defined in claim 21 wherein said waveform generation means generates a tone waveform signal by reading out sample value data from a waveform memory and said amplitude control function controls the amplitude of said tone waveform signal.

23. A tone waveform generation device as defined in claim 21 wherein said waveform generation means generates a tone waveform signal by a frequency modulation operation and said amplitude control function controls the amplitude of said tone waveform signal.

24. A tone waveform generation device as defined in claim 17 wherein said waveform generation means generates a tone waveform signal by a modulation operation and the functions generated by said function generation means include a function of a modulation degree control signal controlling the modulation degree of the modulation operation.

25. A tone waveform generation device as defined in claim 17 wherein said waveform generation means comprises a digital filter for controlling a tone color of a tone to be generated and the plural kinds of functions generated by said function generation means include a function of filter coefficients to be supplied to said digital filter.

26. A tone waveform generation device as defined in claim 17 which further comprises control value generation means for supplying, on a real time basis, a control value for controlling forming of a tone waveform signal in said waveform generation means, and wherein the plural kinds of functions generated by said function generation means include a function of an interpolated control value obtained by interpolating between supplied control values successively supplied by said control value generation means so as to timewise smoothly change.

27. A tone waveform generation device as defined in claim 26 wherein said control value is level data controlling tone volume of a tone to be generated.

28. A tone waveform generation device as defined in claim 26 wherein said waveform generation means comprises a digital filter for controlling a tone color of a tone to be generated and the control value generated by said control value generation means includes a control value of a filter coefficients to be supplied to said digital filter.

29. A tone signal generation device comprising:

waveform supply means for supplying sample value data on the basis of which a tone waveform is formed;

function generation means for generating plural kinds of functions necessary for generating a single tone; and waveform processing means for subjecting the sample value data supplied by said waveform supply means to plural processings by a time division multiplexing operation on the basis of the plural kinds of functions supplied by said function generation means thereby to form and output at least one tone waveform signal, wherein:

each of the plural kinds of functions is for achieving a characteristic of the tone waveform signal which is different from that achieved by each other of the plural kinds of functions;

the waveform processing means comprises a plurality of circuits; and the plural processings performed by the waveform processing means by the time division multiplexing operation are performed using common circuits.

30. A tone waveform generation device as defined in claim 29 wherein said plural processings include subjecting the sample value data to a modulation operation by means of a modulating signal.

31. A tone waveform generation device as defined in claim 29 wherein said plural processings include a filter operation processing for processing a tone color.

32. A tone waveform generation device as defined in claim 29 wherein said plural processings include an envelope multiplication operation processing for controlling a tone amplitude.

33. A tone waveform generation device as defined in claim 29 wherein said plural processings include a mute processing for muting a tone when tone volume of the tone is small.

* * * * *